US010188137B2

(12) United States Patent
Dube

(10) Patent No.: US 10,188,137 B2
(45) Date of Patent: Jan. 29, 2019

(54) PROCESS FOR PRODUCING FLAVORANTS AND RELATED MATERIALS

(71) Applicant: R.J. Reynolds Tobacco Company, Winston-Salem, NC (US)

(72) Inventor: Michael Francis Dube, Winston-Salem, NC (US)

(73) Assignee: R.J. Reynolds Tobacco Company, Winston-Salem, NC (US)

( * ) Notice: Subject to any disclaimer, the term of this patent is extended or adjusted under 35 U.S.C. 154(b) by 250 days.

(21) Appl. No.: 15/011,123

(22) Filed: Jan. 29, 2016

(65) Prior Publication Data

US 2016/0213056 A1 Jul. 28, 2016

Related U.S. Application Data

(62) Division of application No. 14/158,058, filed on Jan. 17, 2014, now Pat. No. 9,265,284.

(51) Int. Cl.

| | |
|---|---|
| ***A24B 15/24*** | (2006.01) |
| ***A24B 15/32*** | (2006.01) |
| ***A24B 15/30*** | (2006.01) |
| ***A24B 15/26*** | (2006.01) |

(52) U.S. Cl.

CPC ..... *A24B 15/241* (2013.01); *A24B 15/26* (2013.01); *A24B 15/302* (2013.01); *A24B 15/32* (2013.01)

(58) Field of Classification Search

None

See application file for complete search history.

(56) References Cited

U.S. PATENT DOCUMENTS

| | | | |
|---|---|---|---|
| 2,766,148 | A | 10/1956 | Rowland |
| 2,774,680 | A | 12/1956 | Hackney et al. |
| 3,424,171 | A | 1/1969 | Rooker |
| 4,008,210 | A | 2/1977 | Steele et al. |
| 4,009,290 | A | 2/1977 | Okumori et al. |
| 4,045,879 | A | 9/1977 | Witte |
| 4,056,442 | A | 11/1977 | Huang et al. |
| 4,069,828 | A | 1/1978 | Hall et al. |
| 4,122,104 | A | 10/1978 | Witte |
| 4,144,895 | A | 3/1979 | Fiore |
| 4,150,677 | A | 4/1979 | Osborne, Jr. et al. |
| 4,251,671 | A | 2/1981 | Alter et al. |
| 4,267,847 | A | 5/1981 | Reid |
| 4,268,632 | A | 5/1981 | Wildman et al. |
| 4,289,147 | A | 9/1981 | Wildman et al. |
| 4,298,013 | A | 11/1981 | Semp et al. |
| 4,298,540 | A | 11/1981 | Youn et al. |
| 4,308,877 | A | 1/1982 | Mattina |
| 4,322,569 | A | 3/1982 | Chao et al. |
| 4,334,095 | A | 6/1982 | Baniel |
| 4,347,324 | A | 8/1982 | Wildman et al. |
| 4,351,346 | A | 9/1982 | Brummer et al. |
| 4,359,059 | A | 11/1982 | Brummer et al. |
| 4,359,417 | A | 11/1982 | Karnofsky et al. |
| 4,381,407 | A | 4/1983 | Bremus et al. |
| 4,456,556 | A | 6/1984 | Grimsby |
| 4,456,557 | A | 6/1984 | Grimsby |
| 4,466,923 | A | 8/1984 | Friedrich |
| 4,476,881 | A | 10/1984 | Gravely et al. |
| 4,506,682 | A | 3/1985 | Muller |
| 4,515,726 | A | 5/1985 | Sullivan |
| 4,589,428 | A | 5/1986 | Keritsis |
| 4,605,016 | A | 8/1986 | Soga et al. |
| 4,612,942 | A | 9/1986 | Dobberstein et al. |
| 4,622,982 | A | 11/1986 | Gaisch et al. |
| 4,716,911 | A | 1/1988 | Poulose et al. |
| 4,727,889 | A | 3/1988 | Niven, Jr. et al. |
| 4,847,106 | A | 7/1989 | Pike et al. |
| 4,887,618 | A | 12/1989 | Bernasek et al. |
| 4,895,175 | A | 1/1990 | Baskevitch et al. |
| 4,941,484 | A | 7/1990 | Clapp et al. |
| 4,967,771 | A | 11/1990 | Fagg et al. |
| 4,986,286 | A | 1/1991 | Roberts et al. |
| 5,005,593 | A | 4/1991 | Fagg |
| 5,018,540 | A | 5/1991 | Grubbs et al. |
| 5,060,669 | A | 10/1991 | White et al. |
| 5,065,775 | A | 11/1991 | Fagg |
| 5,074,319 | A | 12/1991 | White et al. |
| 5,077,071 | A | 12/1991 | Strop |

(Continued)

FOREIGN PATENT DOCUMENTS

| | | |
|---|---|---|
| CN | 1133694 | 10/1996 |
| CN | 1324586 | 12/2001 |
| CN | 101234971 | 8/2008 |
| CN | 101260039 | 9/2008 |
| CN | 101262786 | 9/2008 |
| CN | 101450897 | 6/2009 |
| CN | 101801188 | 8/2010 |
| CN | 102079704 | 6/2011 |
| CN | 102161935 | 8/2011 |
| CN | 10218366 | 9/2011 |
| EP | 0 244 208 | 11/1987 |
| GB | 1 202 821 | 8/1970 |

(Continued)

OTHER PUBLICATIONS

Giannelos et al, "Tobacco seed oil as an alternative diesel fuel: physical and chemical properties", Industrial Crops and Products 16, 2002, pp. 1-9. (Year: 2002).*

(Continued)

*Primary Examiner* — Dennis R Cordray

(74) *Attorney, Agent, or Firm* — Womble Bond Dickinson (US) LLP

(57) ABSTRACT

A process for producing flavorants made or derived from tobacco or, more generally, made or derived from any biomass derived from any one or more species of genus *Nicotiana*, or that otherwise incorporate tobacco, is provided. Provided are flavorants obtained or derived from plants or portions of plants from the *Nicotiana* species, such as from one or more flowers from one or more *Nicotiana* species, and products comprising one or more such flavorants.

11 Claims, 9 Drawing Sheets

(56) References Cited

U.S. PATENT DOCUMENTS

| | | | |
|---|---|---|---|
| 5,099,862 | A | 3/1992 | White et al. |
| 5,121,757 | A | 6/1992 | White et al. |
| 5,131,415 | A | 7/1992 | Munoz et al. |
| 5,143,097 | A | 9/1992 | Stephen Sohn et al. |
| 5,148,819 | A | 9/1992 | Fagg |
| 5,159,942 | A | 11/1992 | Brinkley et al. |
| 5,197,494 | A | 3/1993 | Kramer |
| 5,230,354 | A | 7/1993 | Smith et al. |
| 5,234,008 | A | 8/1993 | Fagg |
| 5,235,992 | A | 8/1993 | Sensabaugh, Jr. |
| 5,243,999 | A | 9/1993 | Smith |
| 5,296,621 | A | 3/1994 | Roos et al. |
| 5,301,694 | A | 4/1994 | Raymond et al. |
| 5,318,050 | A | 6/1994 | Gonzalez-Parra et al. |
| 5,343,879 | A | 9/1994 | Teague |
| 5,360,022 | A | 11/1994 | Newton et al. |
| 5,397,571 | A | 3/1995 | Roland et al. |
| 5,426,220 | A | 6/1995 | Baniel et al. |
| 5,435,325 | A | 7/1995 | Clapp et al. |
| 5,445,169 | A | 8/1995 | Brinkley et al. |
| 5,533,530 | A | 7/1996 | Young et al. |
| 5,715,844 | A | 2/1998 | Young et al. |
| 5,724,998 | A | 3/1998 | Gellatly et al. |
| 5,859,263 | A | 1/1999 | Ghorpade et al. |
| 5,932,095 | A | 8/1999 | Walters et al. |
| 6,083,729 | A | 7/2000 | Martin et al. |
| 6,131,584 | A | 10/2000 | Lauterbach |
| 6,216,706 | B1 | 4/2001 | Kumar et al. |
| 6,225,483 | B1 | 5/2001 | Franke |
| 6,262,284 | B1 | 7/2001 | Khachik |
| 6,298,858 | B1 | 10/2001 | Coleman, III et al. |
| 6,298,859 | B1 | 10/2001 | Kierulff et al. |
| 6,325,860 | B1 | 12/2001 | Coleman, III |
| 6,403,126 | B1 | 6/2002 | Webster et al. |
| 6,414,172 | B1 | 7/2002 | Garcés et al. |
| 6,417,157 | B1 | 7/2002 | Wadsworth et al. |
| 6,428,624 | B1 | 8/2002 | Coleman, III et al. |
| 6,440,223 | B1 | 8/2002 | Dube et al. |
| 6,495,175 | B2 | 12/2002 | Rao et al. |
| 6,499,489 | B1 | 12/2002 | Coleman, III |
| 6,504,085 | B1 | 1/2003 | Howard |
| 6,591,841 | B1 | 7/2003 | White et al. |
| 6,695,924 | B1 | 2/2004 | Dube et al. |
| 6,772,767 | B2 | 8/2004 | Mua et al. |
| 6,800,318 | B2 | 10/2004 | Kapila et al. |
| 6,860,998 | B1 | 3/2005 | Wilde |
| 6,895,974 | B2 | 5/2005 | Peele |
| 7,025,066 | B2 | 4/2006 | Lawson et al. |
| 7,067,718 | B2 | 6/2006 | Anai et al. |
| 7,074,449 | B1 | 7/2006 | Holley et al. |
| 7,156,981 | B2 | 1/2007 | Wilde et al. |
| 7,179,930 | B2 | 2/2007 | Bhaskaran et al. |
| 7,198,808 | B2 | 4/2007 | Krasutsky et al. |
| 7,271,298 | B2 | 9/2007 | Xu et al. |
| 7,337,782 | B2 | 3/2008 | Thompson |
| 7,351,424 | B2 | 4/2008 | Ornelas-Cravioto et al. |
| 7,615,657 | B2 | 11/2009 | Bathurst et al. |
| 7,622,599 | B2 | 11/2009 | Swaminathan et al. |
| 7,629,007 | B2 | 12/2009 | Peña |
| 7,638,314 | B2 | 12/2009 | Zappi et al. |
| 7,652,167 | B2 | 1/2010 | Miller et al. |
| 7,667,068 | B2 | 2/2010 | Miller et al. |
| 7,671,242 | B2 | 3/2010 | Losso et al. |
| 7,741,500 | B2 | 6/2010 | Arhancet et al. |
| 7,820,419 | B2 | 10/2010 | Smith et al. |
| 7,910,209 | B2 | 3/2011 | Uchida et al. |
| 7,943,350 | B2 | 5/2011 | Vlasenko et al. |
| 8,236,929 | B2 | 8/2012 | Cheryan et al. |
| 8,247,423 | B2 | 8/2012 | Estok et al. |
| 8,360,072 | B2 | 1/2013 | Krauss |
| 8,389,749 | B2 | 3/2013 | Dumesic et al. |
| 8,893,725 | B2 | 11/2014 | Dube et al. |
| 2002/0197688 | A1 | 12/2002 | Pandolfino |
| 2004/0173228 | A1 | 9/2004 | Coleman, III |
| 2005/0147722 | A1 | 7/2005 | Fan et al. |
| 2006/0003036 | A1 | 1/2006 | Shaath et al. |
| 2007/0137663 | A1 | 6/2007 | Taylor et al. |
| 2007/0193596 | A1 | 8/2007 | Mori et al. |
| 2007/0277432 | A1 | 12/2007 | Jackam et al. |
| 2009/0028803 | A1 | 1/2009 | Mishra et al. |
| 2009/0234146 | A1 | 9/2009 | Cooney et al. |
| 2010/0017916 | A1 | 1/2010 | Pappan et al. |
| 2010/0037903 | A1 | 2/2010 | Coleman, III et al. |
| 2010/0196980 | A1 | 8/2010 | Smith et al. |
| 2010/0197029 | A1 | 8/2010 | O'Fallon et al. |
| 2010/0239726 | A1 | 9/2010 | Pertsovich |
| 2010/0286420 | A1 | 11/2010 | Akatsuka et al. |
| 2011/0083683 | A1 | 4/2011 | Krauss |
| 2011/0174323 | A1 | 7/2011 | Coleman, III et al. |
| 2011/0247640 | A1 | 10/2011 | Beeson et al. |
| 2011/0259353 | A1 | 10/2011 | Coleman, III et al. |
| 2012/0040408 | A1 | 2/2012 | Decker et al. |
| 2012/0125354 | A1 | 5/2012 | Byrd et al. |
| 2012/0141648 | A1 | 6/2012 | Morton et al. |
| 2012/0152265 | A1 | 6/2012 | Dube et al. |
| 2012/0192880 | A1 | 8/2012 | Dube et al. |
| 2012/0211016 | A1 | 8/2012 | Byrd, Jr. et al. |
| 2012/0260929 | A1 | 10/2012 | Coleman et al. |
| 2012/0272976 | A1 | 11/2012 | Byrd et al. |
| 2012/0312314 | A1 | 12/2012 | Plakidis et al. |
| 2013/0014771 | A1 | 1/2013 | Coleman, III et al. |
| 2013/0125907 | A1 | 5/2013 | Dube et al. |
| 2013/0276801 | A1 | 10/2013 | Byrd, Jr. et al. |
| 2014/0031592 | A1 | 1/2014 | Shinde |
| 2014/0096780 | A1 | 4/2014 | Gerardi |
| 2014/0256829 | A1 | 9/2014 | Junker |
| 2014/0271951 | A1 | 9/2014 | Mua et al. |
| 2014/0271952 | A1 | 9/2014 | Mua et al. |
| 2014/0271957 | A1 | 9/2014 | Young |
| 2015/0040922 | A1 | 2/2015 | Dube et al. |
| 2015/0201669 | A1 | 7/2015 | Junker et al. |

FOREIGN PATENT DOCUMENTS

| | | |
|---|---|---|
| GB | 2 020 538 A | 11/1979 |
| JP | 59-28465 A | 2/1984 |
| JP | H08-266260 | 10/1996 |
| JP | 1162008 | 10/1997 |
| JP | H-11308987 | 11/1999 |
| JP | H-11332408 | 12/1999 |
| JP | 2003024096 | 1/2003 |
| JP | 2009527488 | 7/2009 |
| KR | 93 0003904 | 5/1993 |
| KR | 10-2006-0054728 | 5/2006 |
| KR | 1020120022238 | 3/2012 |
| KR | 101233116 | 2/2013 |
| WO | WO 02/083191 | 10/2002 |
| WO | WO 2005/027892 | 3/2005 |
| WO | WO 2008/092207 | 8/2008 |
| WO | WO 2009/075762 | 6/2009 |
| WO | WO 2009/110775 A1 | 9/2009 |
| WO | WO 2010/054198 A2 | 5/2010 |
| WO | WO 2013/085870 | 6/2013 |

OTHER PUBLICATIONS

Mukhtar et al, "Fatty Acid Composition of Tobacco Seed Oil and Synthesis of Alkyd Resin", Chinese Journal of Chemistry, 2007, 25, pp. 705-708. (Year: 2007).*

Alonso et al., "Integrated Conversion of Hemicellulose and Cellulose from Lignocellulosic Biomass" *Energy & Environmental Science*, 2013, vol. 6, pp. 76-80.

Brandt et al., "Practical Aspects of Preparative HPLC in Pharmaceutical and Development Production", *LC GC Europe*, Mar. 2002, pp. 2-5.

Bryzgalov et al., "Comparative Life Cycle Assessment of General Loose and Portion Snus", *1N1800 Life Cycle Assessment*, May 26, 2005, pp. 3-23.

Chu et al, "Fatty Acid Composition in Tobacco, I. Green Tobacco Plants", Plant Physiology, American Society of Plant Biologists, Mar. 1968; 43(3): 428-433, [online], retrieved from the Internet,

(56) References Cited

OTHER PUBLICATIONS

[retrieved Jun. 24, 2015], <URL:http://www.ncbi.nlm.nih.gov/pmc/articles/PMC1086856/>.
Clark et al., "Derivatization Solid-Phase Microextraction Gas Chromatographic-Mass Spectrometric Determination of Organic Acids in Tobacco"; 1997; Journal of Chromatographic Science; vol. 35; pp. 209-212
Coleman, III et al., "Headspace Solid-Phase Microextraction Analysis of Artificial Flavors", *J. Sci. Food Agric.*, 2005, pp. 2645-2654, vol. 85.
Coleman, III et al., "The Use of a Non-Equilibrated Solid Phase Microextraction Method to Quantitatively Determine the Off-Notes in Mint and Other Essential Oils", *J. Sci. Food Agric.*, 2004, pp. 1223-1228, vol. 84.
Crabbe et al., "Biodiesel Production of Crude Palm Oil and Evaluation of Butanol Extraction and Fuel Properties," *Process Biochemistry*, 37, 65-71, (2001).
"Enzyme Class Index: Hydrolases on esters", Sigma-Aldrich, 2014, [online], Retrieved from the Internet, [retrieved Oct. 21, 2014], <URL: http://www.sigmaaldrich.com/life-science/metabolomics/enzyme-explorer/class-index/hydrolases-on-esters.html>.
Frega et al., "Chemical Composition of Tobacco Seeds (*Nicotiana tobacum* L.)", *JAOCS.*, 1991, vol. 68, No. 1, pp. 29-33.
Giannelos et al., "Tobacco Seed Oil as an Alternative Diesel Fuel: Physical and Chemical Properties", *Industrial Crops and Products*,2002, vol. 16, pp. 1-9.
Ishikawa et al., "Water-Soluble Constituents of Dill", *Chem. Pharm. Bull.*, 2002, pp. 501-507, vol. 50., No. 4.
Kodama et al., "Isolation of a New Terpene Glucoside, 3-Hydroxy-5, 6-epoxy-β-ionyl-β-D-glucopyranoside from Flue-cured Tobacco", *Agric. Biol. Chem.*, 1981, pp. 941-944, vol. 45, No. 4.
Kolah et al. "Reaction Kinetics of the Catalytic Esterification of Citric Acid with Ethanol", 2007; Industrial Engineering and Chemistry Research; vol. 46; pp. 3180-3187; American Chemical Society.
Ejikeme et al., "Catalysis in Biodiesel Production by Trans-Esterification Processes: An Insight," *Journal Chemistry*, 7, 1120-1132 (2010).
Freedman et al., "Trans-Esterification Kinetics of Soybean Oil," *JAOCS*, 63, 1375-1380 (1986).
Kolah et al. (2008), "Triethyl Citrate Synthesis by Reactive Distillation," *Industrial and Engineering Chemistry Research*, vol. 47, No. 4, pp. 1017-1024.
Leffingwell & Associates, Ester Detection Thresholds and Molecular Structures, www.leffingwell.com/esters, downloaded Sep. 23, 2015.
Leffingwell et al., "Tobacco Flavoring for Smoking Products", *R. J. Reynolds Tobacco Company*, 1972, pp. 1-72.
Li et al. Nanfang Nongye Xuebao. 2012. vol. 43, No. 8, pp. 1158-1163. CAPLUS Abstract enclosed.
Liu et al. J. Henan Agricult. Sci. 2012. vol. 41, No. 9, pp. 50-52. CAPLUS Abstract enclosed. Abstract.
Loughrin et al., "Headspace Compounds from Flowers of *Nicotiana tabacum* and Related Species", *J. Agric. Food Chem.*, 1990, vol. 38, No. 2, pp. 455-460.
Loughrin et al., "Glycosidically Bound Volatile Components of *Nicotiana sylvestris* and *N. Suaveolens* Flowers", *Phytochemistry*, 1992, pp. 1537-1540, vol. 31, No. 5.
Marchetti et al..; "Possible Methods for Biodiesel Production"; Renewable and Sustainable Energy Review; pp. 1300-1311; vol. 11; No. 6; 2007; US.
Matsumura et al., "Water-Soluble Constituents of Caraway: Carvone Derivatives and their Glucosides", *Chem. Pharm. Bull.*, 2002, pp. 66-72, vol. 50, No. 1.
Matsuzake et al.; "Novel Glycerolipids and Glycolipids from the Surface Lipids of Nicotiana Benthamiana". Biosci. Biotech_Biochem; Mar. 1992; pp. 1565-1569; vol. 56; No. 10; JP.
Moldoveanu et al., "Dual Analysis of Triglycerides from Certain Common Lipids and Seed Extracts," *J. Agric.Food Chem.*, 59, 2137-2147 (2011).
Moldoveanu, "5. Profiling of lipids from fruit and seed extracts", Lipidomics: Sea Food, Marine.Based Dietary Supplement, Fruit and Seed, 2012: pp. 73-123, Ed. Su Chen [online], Retrieved from the Internet, [retrieved Oct. 21, 2014], <URL: http://www.trnres.com/ebook/uploads/suchencontent/T_13743193085)/020Su%20Chen.pdf>.
Mukhtar et al., "Fatty Acid Composition of Tobacco Seed Oil and Synthesis of Alkyd Resin", *Chin J. of Chem.*, 2007, vol. 25, No. 5, pp. 705-708.
Satynaryana Murthy, "Performance of Tobacco Oil Based Bio-Diesel Fuel in a Single cylinder Direct Injection Engine," *International J. Physical Sci.*, 5, 2066-2074 (2010).
Ochiai, N., "6 Times Faster Screening of Pesticide Multi-Residues in Aqueous Samples Take Two!" *Gerstel Solutions Worldwide*, 2006, pp. 17-19, No. 6.
Patel et al., "Production Potential and Quality Aspects of Tobacco Seed Oil", *Tob. Res.*, 1998, vol. 24, No. 1, pp. 44-49.
Perflavory Information System, www.perflavory.com, downloaded Sep. 23, 2015.
Raguso et al., "Fragrance Chemistry, Nocturnal Rhythms and Pollination "Syndromes" in *Nicotiana", Phytochemistry*, 2003, pp. 265-284, vol. 63.
Ralph et al., "NMR Characterization of Altered Lignins Extracted from Tobacco Plants Down-Regulated for Lignification Enzymes Cinnamyl-Alcohol Dehydrogenase and Cinnamoyl-CoA Reductase" *Proceedings of the National Academy of Sciences*, 1998, vol. 95, pp. 12803-12808. http://www.ncbi.nlm.nih.gov/pmc/articles/PMC23601/.
Sadecka, et al.; Determination of organic acids in tobacco by capillary isotachophoresis; 2003; Journal of Chromatography A; vol. 988; pp. 161-165; Elsevier Science B.V.
Sahraoui et al., "Improved Microwave Steam Distillation Apparatus for Isolation of Essential Oils Comparison with Conventional Steam Distillation", *J. Chromatogr. A.*, 2008, pp. 229-233.
Schuchardt et al., "Trans-Esterification of Vegetable Oils: A Review," Chem. Soc., 9, 199-210 (1998).
Shmuk et al. (1930), "Investigation of the Tobacco Acids," in Works of Academician A.A. Shmuk, vol. III, The Chemistry and Technology of Tobacco (Moscow: Pishchepromidzat, 1953; Jerusalem: trans. Lengy et al., Israel Program for Scientific Translations, 1961), pp. 136-144.
Shmuk et al. (1933), "Tobacco and Makhorka as Raw Materials for the Production of Citric Acid," in Works, op. cit., pp. 688-707.
Shmuk (1934), "The Method of Determination of Citric and Malic Acids in Tobacco and Makhorka," Ibid., pp. 247-251.
Snook et al., "The Flower Flavonols of *Nicotiana* Species", *Phytochemistry*, 1992, pp. 1639-1647, vol. 31, No. 5.
Stanisavljevic et al., "Comparison of techniques for the Extraction of Tobacco Seed Oil", *Eur. J. Lipid Sci. Technol.*, 2009, vol. 111, pp. 513-518.
Stanisavljević et al., Ultrasonic extraction of oil from tobacco (*Nicotiana tabacum* L.) seeds, *Ultrasonics Sonochemistry*, 2007, pp. 646-652, vol. 14, No. 5.
Stanesh, Biochemistry, Chapter 6. Lipids and Membranes, Springer Science+Business Media, 1998, pp. 141-144.
Tienpont et al., "Stir Bar Sorptive Extraction-Thermal Desorption-Capillary GC-MS Applied to Biological Fluids", *Anal. Bioanal. Chem..*, 2002, pp. 46-55, vol. 373.
TSO (1972), Physiology and Biochemistry of Tobacco Plants (Stroudsburg: Dowden, Hutchinson and Ross), p. 205.
Veljkovic V B et al.; "Biodiesel Production from Tobacco Seed Oil with a High Content of Free Fatty Acids"; Fuel, IPC Science and Technology Press; pp. 2671-2675; vol. 85; No. 17; GB.
Vickery et al. The Non-Volatile Organic Acids of Green Tobacco Leaves; 1931; Journal of Biological Chemistry; vol. 90; pp. 637-653.
Winayanuwattikun P et all; "Potential Plant Oil Feedstock for Lipase-Catalyzed Biodiesel Production in Thailand"; Biomass and Bioenergy; pp. 1279-1286; vol. 32; No. 12; 2008; Amsterdam, NL.
Wu et al. Yunnan Nongye Daxue Xuebao. 2013. vol. 28, No. 3, pp. 353-359. CAPLUS Abstract enclosed.
Xi et al. Yancao Keji. 2011. vol. 5, pp. 29-33. CAPLUS Abstract enclosed.

(56) References Cited

OTHER PUBLICATIONS

Zhang, Yi-Heng Percival et al., Toward an Aggregated Understanding of Enzymatic Hydrolysis of Cellulose: Noncomplexed Cellulase Systems. Wiley InterScience. Biotechnology and Bioengineering, vol. 88, No. 7, Dec. 30, 2004, p. 797-824.

Zhang et al., "Advances in the Catalytic Production and Utilization of Sorbitol," *Industrial & Engineering Chemistry Research*, 2013, vol. 52, p. 11799-11815.

Ziaie-Shirkolaee et al. "Study on Cellulose Degradation During Organosols Delignification of Wheat Straw and Evaluation of Pulp Properties," *Iranian Polymer Journal*, 2007, pp. 83-96, vol. 16, (2).

Anonymous, "Fragrance extraction—Wikipedia, the free encyclopedia," May 22, 2013, XP055391477, Retrieved from the Internet: URL: https://web.archive.org/web/20130522203433/https://en.wikpedia.org/wiki/Fragrance_extraction [retrieved on Jul. 17, 2017].

* cited by examiner

| PEAK # | RET TIME | AREA | AREA % | ID | CAS # |
|---|---|---|---|---|---|
| 1 | 4.524 | 1833281 | 0.11 | ETHYL 2-METHYLBUTYRATE | 7452-79-1 |
| 2 | 4.744 | 1241473 | 0.08 | | |
| 3 | 5.611 | 680167 | 0.04 | ETHYL 2-METHYLBUTYRATE | 7452-79-1 |
| 4 | 5.77 | 559803 | 0.04 | | |
| 5 | 7.12 | 12235894 | 0.77 | C6 ETHYL ESTER | |
| 6 | 7.747 | 80714546 | 5.06 | ETHYL HEXANOATE | 123-66-0 |
| 7 | 8.55 | 3967384 | 0.25 | C7 ETHYL ESTER | |
| 8 | 8.628 | 115708 | 0.01 | | |
| 9 | 8.686 | 382417 | 0.02 | ETHYL CIS-3-HEXENOATE | 64187-83-3 |
| 10 | 8.76 | 4811272 | 0.30 | ETHYL ESTER | |
| 11 | 9.239 | 4212099 | 0.26 | ETHYL HEPTANOATE | 106-30-9 |
| 12 | 10.091 | 17281489 | 1.08 | C8 ETHYL ESTER | |
| 13 | 11.003 | 1.43E+09 | 89.34 | ETHYL OCTANOATE | 106-32-1 |
| 14 | 15.557 | 1979215 | 0.12 | ETHYL NONANOATE | 123-29-5 |
| 15 | 16.146 | 5780800 | 0.36 | C9 ETHYL ESTER | |
| 16 | 16.635 | 2059367 | 0.13 | C10 ETHYL ESTER | |
| 17 | 17.088 | 32228139 | 2.02 | ETHYL DECANOATE | 110-38-3 |

| PEAK # | RET TIME | AREA | AREA % | ID | CAS # |
|---|---|---|---|---|---|
| 1 | 4.53 | 3410304 | 0.14 | ISOPROPYL 2-METHYLBUTANOATE | 66576-71-4 |
| 2 | 4.702 | 1078141 | 0.04 | | |
| 3 | 5.527 | 1693779 | 0.07 | ISOPROPYL 2-METHYLBUTANOATE | 66576-71-4 |
| 4 | 5.67 | 483548 | 0.02 | | |
| 5 | 5.721 | 352370 | 0.01 | ISOPROPYL 3-METHYLBUTANOATE | 32665-23-9 |
| 6 | 6.563 | 808453 | 0.03 | ISOPROPYL HEXANOATE | 2311-46-8 |
| 7 | 6.929 | 499200 | 0.02 | | |
| 8 | 7.058 | 34374264 | 1.41 | ISOPROPYL HEXANOATE | 2311-46-8 |
| 9 | 7.696 | 1.66E+08 | 6.80 | ISOPROPYL HEXANOATE | 2311-46-8 |
| 10 | 8.472 | 9341404 | 0.38 | C7 ISOPROPYL ESTER | |
| 11 | 8.537 | 2300558 | 0.09 | | |
| 12 | 8.67 | 11119337 | 0.46 | | |
| 13 | 9.165 | 9544414 | 0.39 | ISOPROPYL HEPTANOATE | 7778-87-2 |
| 14 | 9.777 | 782150 | 0.03 | | |
| 15 | 10.023 | 31052986 | 1.27 | C8 ISOPROPYL ESTER | |
| 16 | 10.906 | 2.04E+09 | 83.69 | ISOPROPYL OCTANOATE | 5458-59-3 |
| 17 | 16.784 | 3615270 | 0.15 | | |
| 18 | 17.195 | 59807654 | 2.45 | ISOPROPYL DECANOATE | 2311-59-3 |
| 19 | 20.396 | 3122746 | 0.13 | OCTANOIC ACID | 124-07-2 |

| PEAK # | RET TIME | AREA | AREA % | ID | CAS # |
|---|---|---|---|---|---|
| 1 | 5.022 | 6985813 | 0.28 | ISOAMYL ESTER | |
| 2 | 6.006 | 849441 | 0.03 | | |
| 3 | 6.689 | 4900063 | 0.19 | ISOAMYL ALCOHOL | 123-51-3 |
| 4 | 7.66 | 21138745 | 0.83 | | |
| 5 | 7.939 | 10423046 | 0.41 | | |
| 6 | 9.207 | 490616 | 0.02 | | |
| 7 | 9.667 | 22911193 | 0.90 | | |
| 8 | 10.275 | 873264 | 0.03 | | |
| 9 | 10.411 | 3056228 | 0.12 | | |
| 10 | 10.89 | 19034555 | 0.75 | ISOAMYL HEXANOATE | 2198-61-0 |
| 11 | 11.198 | 358903 | 0.01 | | |
| 12 | 11.573 | 1.21E+08 | 4.76 | ISOAMYL ESTER | |
| 13 | 11.903 | 3.15E+08 | 12.40 | | |
| 14 | 12.276 | 7408609 | 0.29 | | |
| 15 | 12.463 | 7685735 | 0.30 | | |
| 16 | 12.713 | 1119840 | 0.04 | | |
| 17 | 12.868 | 611906 | 0.02 | | |
| 18 | 12.949 | 10244272 | 0.40 | ISOAMYL HEPTANOATE | 109-25-1 |
| 19 | 13.179 | 70928824 | 2.79 | | |
| 20 | 13.729 | 28578303 | 1.13 | | |
| 21 | 13.832 | 10059933 | 0.40 | | |
| 22 | 14.603 | 1.66E+09 | 65.41 | ISOAMYL OCTANOATE | 2035-99-6 |

PROCESS FOR PRODUCING FLAVORANTS AND RELATED MATERIALS

CROSS-REFERENCE TO RELATED APPLICATIONS

This application is a divisional of U.S. application Ser. No. 14/158,058, filed Jan. 17, 2014, which is herein incorporated by reference in its entirety.

FIELD OF THE INVENTION

A process such as is described in various embodiments herein relates to products comprising flavorants made or derived from tobacco or, more generally, made or derived from any biomass derived from any one or more species of genus *Nicotiana*, or that otherwise incorporate tobacco. Of particular interest are products comprising flavorants obtained or derived from plants or portions of plants from *Nicotiana* species.

BACKGROUND OF THE INVENTION

Popular smoking articles, such as cigarettes, have a substantially cylindrical rod shaped structure and include a charge, roll or column of smokable material such as shredded tobacco (e.g., in cut filler form) surrounded by a paper wrapper thereby forming a so-called "tobacco rod." Normally, a cigarette has a cylindrical filter element aligned in an end-to-end relationship with the tobacco rod. Typically, a filter element comprises plasticized cellulose acetate tow circumscribed by a paper material known as "plug wrap." Certain cigarettes incorporate a filter element having multiple segments, and one of those segments can comprise activated charcoal particles. Typically, the filter element is attached to one end of the tobacco rod using a circumscribing wrapping material known as "tipping paper." It also has become desirable to perforate the tipping material and plug wrap, in order to provide dilution of drawn mainstream smoke with ambient air. A cigarette is employed by a smoker by lighting one end thereof and burning the tobacco rod. The smoker then receives mainstream smoke into his/her mouth by drawing on the opposite end (e.g., the filter end) of the cigarette.

The tobacco used for cigarette manufacture is typically used in blended form. For example, certain popular tobacco blends, commonly referred to as "American blends," comprise mixtures of flue-cured tobacco, burley tobacco, and Oriental tobacco, and in many cases, certain processed tobaccos, such as reconstituted tobacco and processed tobacco stems. The precise amount of each type of tobacco within a tobacco blend used for the manufacture of a particular cigarette brand varies from brand to brand. However, for many tobacco blends, flue-cured tobacco makes up a relatively large proportion of the blend, while Oriental tobacco makes up a relatively small proportion of the blend. See, for example, Tobacco Encyclopedia, Voges (Ed.) p. 44-45 (1984), Browne, The Design of Cigarettes, 3rd Ed., p. 43 (1990) and Tobacco Production, Chemistry and Technology, Davis et al. (Eds.) p. 346 (1999).

Through the years, various treatment methods and additives have been proposed for altering the overall character or nature of tobacco materials utilized in tobacco products. For example, additives or treatment processes have been utilized in order to alter the chemistry or sensory properties of the tobacco material, or in the case of smokable tobacco materials, to alter the chemistry or sensory properties of mainstream smoke generated by smoking articles including the tobacco material. The sensory attributes of cigarette smoke can be enhanced by incorporating flavoring materials into various components of a cigarette. Exemplary flavoring additives include menthol and products of Maillard reactions, such as pyrazines, aminosugars, and Amadori compounds. See also, Leffingwell et al., Tobacco Flavoring for Smoking Products, R.J. Reynolds Tobacco Company (1972), which is incorporated herein by reference. In some cases, treatment processes involving the use of heat can impart to the processed tobacco a desired color or visual character, desired sensory properties, or a desired physical nature or texture. Various processes for preparing flavorful and aromatic compositions for use in tobacco compositions are set forth in U.S. Pat. No. 3,424,171 to Rooker; U.S. Pat. No. 3,476,118 to Luttich; U.S. Pat. No. 4,150,677 to Osborne, Jr. et al.; U.S. Pat. No. 4,986,286 to Roberts et al.; U.S. Pat. No. 5,074,319 to White et al.; U.S. Pat. No. 5,099,862 to White et al.; U.S. Pat. No. 5,235,992 to Sensabaugh, Jr.; U.S. Pat. No. 5,301,694 to Raymond et al.; U.S. Pat. No. 6,298,858 to Coleman, III et al.; U.S. Pat. No. 6,325,860 to Coleman, III et al.; U.S. Pat. No. 6,428,624 to Coleman, III et al.; U.S. Pat. No. 6,440,223 to Dube et al.; U.S. Pat. No. 6,499,489 to Coleman, III; U.S. Pat. No. 6,591,841 to White et al.; and U.S. Pat. No. 6,695,924 to Dube et al.; and US Pat. Appl. Publication Nos. 2004/0173228 to Coleman, III; 2010/0037903 to Coleman, III et al.; and 2013/0014771 to Coleman, III et al., each of which is incorporated herein by reference. Additionally, examples of representative components that can be employed as so-called natural tar diluents in tobacco products are set in PCT WO 07/012980 to Lipowicz, which is incorporated herein by reference.

Tobacco also may be enjoyed in a so-called "smokeless" form. Particularly popular smokeless tobacco products are employed by inserting some form of processed tobacco or tobacco-containing formulation into the mouth of the user. Various types of smokeless tobacco products are set forth in U.S. Pat. No. 1,376,586 to Schwartz; U.S. Pat. No. 3,696,917 to Levi; U.S. Pat. No. 4,513,756 to Pittman et al.; U.S. Pat. No. 4,528,993 to Sensabaugh, Jr. et al.; U.S. Pat. No. 4,624,269 to Story et al.; U.S. Pat. No. 4,987,907 to Townsend; U.S. Pat. No. 5,092,352 to Sprinkle, III et al.; U.S. Pat. No. 5,387,416 to White et al.; and U.S. Pat. No. 8,336,557 to Kumar et al.; US Pat. Appl. Pub. Nos. 2005/0244521 to Strickland et al. and 2008/0196730 to Engstrom et al.; PCT WO 04/095959 to Arnarp et al.; PCT WO 05/063060 to Atchley et al.; PCT WO 05/016036 to Bjorkholm; and PCT WO 05/041699 to Quinter et al., each of which is incorporated herein by reference. See, for example, the types of smokeless tobacco formulations, ingredients, and processing methodologies set forth in U.S. Pat. No. 6,953,040 to Atchley et al. and U.S. Pat. No. 7,032,601 to Atchley et al., each of which is incorporated herein by reference.

One type of smokeless tobacco product is referred to as "snuff." Representative types of moist snuff products, commonly referred to as "snus," have been manufactured in Europe, particularly in Sweden, by or through companies such as Swedish Match AB, Fiedler & Lundgren AB, Gustavus AB, Skandinavisk Tobakskompagni A/S, and Rocker Production AB. Snus products available in the U.S.A. have been marketed under the tradenames Camel Snus Frost, Camel Snus Original and Camel Snus Spice by R. J. Reynolds Tobacco Company. See also, for example, Bryzgalov et al., 1N1800 Life Cycle Assessment, Comparative Life Cycle Assessment of General Loose and Portion Snus (2005). In addition, certain quality standards associated with snus manufacture have been assembled as a so-called GothiaTek standard. Representative smokeless tobacco products also have been marketed under the tradenames Oliver Twist by House of Oliver Twist A/S; Copenhagen, Skoal, SkoalDry, Rooster, Red Seal, Husky, and Revel by U.S. Smokeless Tobacco Co.; "taboka" by Philip Morris USA; Levi Garrett, Peachy, Taylor's Pride, Kodiak, Hawken Wintergreen, Grizzly, Dental, Kentucky King, and Mammoth Cave by Conwood Company, LLC; and Camel Orbs, Camel Sticks, and Camel Strips by R. J. Reynolds Tobacco Company.

The sensory attributes of smokeless tobacco can also be enhanced by incorporation of certain flavoring materials. See, for example, U.S. Pat. No. 6,668,839 to Williams; U.S. Pat. No. 6,834,654 to Williams; U.S. Pat. No. 7,032,601 to Atchley et al.; U.S. Pat. No. 7,694,686 to Atchley et al.; U.S. Pat. No. 7,861,728 to Holton, Jr. et al.; U.S. Pat. No. 7,819,124 to Strickland et al.; U.S. Pat. No. 7,810,507 to Dube et al.; and U.S. Pat. No. 8,168,855 to Nielsen et al; US Pat. Appl. Pub. Nos. 2004/0020503 to Williams, 2006/0191548 to Strickland et al.; 2007/0062549 to Holton, Jr. et al.; 2008/0029116 to Robinson et al.; 2008/0029117 to Mua et al.; and 2008/0173317 to Robinson et al., each of which is incorporated herein by reference.

Because tobacco has long been cultivated throughout the world, though full utilization of tobacco biomass has yet to be attained, there is a long-felt need for a process for preparing from tobacco, or, more generally, from any one or more portions of any one or more members of genus *Nicotiana*, a material useful as a flavorant, inter alia, in the manufacture of smoking articles and/or smokeless tobacco products.

SUMMARY OF EMBODIMENTS

A process such as is described in various embodiments herein provides materials from *Nicotiana* species (e.g., tobacco-derived materials) comprising isolated components from plants of the *Nicotiana* species useful for incorporation into tobacco compositions utilized in a variety of tobacco products, such as smoking articles and smokeless tobacco products, or more generally into compositions that may comprise a flavorant. A process such as is described in various embodiments herein also provides processes for isolating components from *Nicotiana* species (e.g., tobacco materials), and processes for processing those components and tobacco materials incorporating those components. For example, tobacco-derived materials can be prepared by subjecting at least a portion of a tobacco plant (e.g., leaves, stalks, roots, or stems) to a separation process, which typically can include multiple sequential extraction steps, in order to isolate desired components of the tobacco material. For example, tobacco-derived materials can be prepared by subjecting at least a portion of a tobacco plant (e.g., leaves, stalks, roots, or stems) to a separation process, which typically can include multiple sequential extraction steps, in order to isolate desired components of the tobacco material.

When used in connection with a process such as is described in various embodiments herein, the term "biomass" denotes any one or more portions of a plant, and in particular denotes substantially the entirety of the superterranean portion of a plant, optionally including some or all of the subterranean portion of a plant. Accordingly, the term "biomass" may refer to flower or to leaf or to seed or to any other superterranean portion of a plant, or to any combination thereof, optionally including some or all of the subterranean portion of a plant. Accordingly, the term "biomass" and related terms such as "biomatter" and "plant source" may be properly understood to refer to any one or more portions of a harvested plant that may be processed to extract, separate, or isolate components of interest therefrom.

When used in connection with a process such as is described in various embodiments herein, the term "one or more plants of genus *Nicotiana*" denotes any one or more plants of the genus *Nicotiana* of family Solanaceae, including, for example, any one or more of the following: *N. alata, N. arentsii, N. excelsior, N. forgetiana, N. glauca, N. glutinosa, N. gossei, N. kawakamii, N. knightiana, N. langsdorffi, N. otophora, N. setchelli, N. sylvestris, N. tomentosa, N. tomentosiformis, N. undulata*, and *N. x sanderae, N. africana, N. amplexicaulis, N. benavidesii, N. bonariensis, N. debneyi, N. longiflora, N. maritina, N. megalosiphon, N. occidentalis, N. paniculata, N. plumbaginifolia, N. raimondii, N. rosulata, N. rustica, N. simulans, N. stocktonii, N. suaveolens, N. tabacum, N. umbratica, N. velutina*, and *N. wigandioides, N. acaulis, N. acuminata, N. attenuata, N. benthamiana, N. cavicola, N. clevelandii, N. cordifolia, N. corymbosa, N. fragrans, N. goodspeedii, N. linearis, N. miersii, N. nudicaulis, N. obtusifolia, N. occidentalis* subsp. *Hersperis, N. pauciflora, N. petunioides, N. quadrivalvis, N. repanda, N. rotundifolia, N. solanifolia, N. spegazzinii.*

The use of *Nicotiana*-derived (e.g., tobacco-derived) materials produced by a process such as is described in various embodiments herein enables the preparation of tobacco compositions for smoking articles or smokeless tobacco compositions that are derived substantially or even entirely from *Nicotiana* materials. For example, a tobacco composition can incorporate tobacco or tobacco-derived material of some form, including isolated components from *Nicotiana* species, such that at least about 80 weight percent, more typically at least about 90 weight percent, or even at least about 95 weight percent (on a dry weight basis), of that tobacco composition consists of tobacco-derived material.

It has long been recognized that there is a need to make fuller use of material or substance from tobacco, and in particular from plants or portions of plants from *Nicotiana* species. Readily available starting materials or inputs from plants or portions of plants from *Nicotiana* species, such starting materials or inputs being useful in particular for inclusion as starting materials or inputs in a process whereby material or substance from tobacco can be more fully utilized, include inter alia tobacco biomass. Tobacco biomass can include for example the entirety of the substance of a tobacco plant that has been harvested whole. Tobacco biomass can include for example essentially all of the superterranean parts of a tobacco plant and optionally can include some or all of the subterranean parts of a tobacco plant. Tobacco biomass can include for example the solid portion of a tobacco plant that has been harvested whole, or the solid portion of essentially all of superterranean parts of a tobacco plant, and from which so-called "green juice" has been expelled for example through the action of a screw press. Tobacco biomass can include for example such a solid portion from which at least a portion of the water has been removed by drying.

Among ways in which fuller use can be made of material or substance from tobacco, and in particular from plants or portions of plants from *Nicotiana* species, are various physical and/or chemical transformations to which plants or portions of plants from *Nicotiana* species can be subjected. Such physical and/or chemical transformations may result in outputs or products having one or more desired or favorable properties. Such outputs or products may themselves be useful as starting material or inputs for further useful processes. Among physical transformations to which plants or portions of plants from *Nicotiana* species can be subjected are disruptions of the physical integrity of tobacco biomass, such as a disruption resulting from the action of a screw press against a quantity of tobacco biomass. Among physical transformations to which plants or portions of plants from *Nicotiana* species can be subjected are fractionations according to, for example, particle size, relative density, sedimentation velocity, or affinity for a fixed matrix.

In an aspect, a process such as is described in various embodiments herein provides a material for use in a smoking article or a smokeless tobacco composition comprising an additive derived from a flower of a *Nicotiana* species. A material can be a flower of a *Nicotiana* species or a portion thereof in particulate form or in the form of a flower derivative derived from a flower of a *Nicotiana* species. A flower derivative may be in the form of an extract from a flower of a *Nicotiana* species or in the form of a chemically transformed flower derivative, exemplary chemical transformations including acid/base reaction, hydrolysis, thermal treatment, enzymatic treatment, and combinations of such steps. A chemical transformation typically results in a change in chemical composition of a tobacco derivative, such as an increase in the amount of certain compounds that have desirable sensory characteristics (e.g., aromatic or flavorful compounds). In certain embodiments, a process such as is described in various embodiments herein provides techniques adapted for expressing lipids from biomass, such as from flower or from seed, such as high pressure squeezing or cold pressing. Alternatively, a component containing tobacco oil according to a process such as is described in various embodiments herein is formed by extracting components from biomass, such as from flower or from seed, using appropriate extraction techniques and solvents. Exemplary solvents include hydrocarbons such as heptane and hexane. Other separation processes can be used, such as chromatography, distillation, filtration, recrystallization, solvent-solvent partitioning, and combinations thereof. An oil-containing component formed using an extraction process can be either the solvent-soluble portion or the insoluble residue of biomass or seed material remaining after solvent extraction. An oil-containing component formed using a pressing process may be inter alia a lipid-containing portion of biomass, such as flower or seed, expressed from pressed biomass, such as flower or seed material.

In an aspect, a flower derivative is in the form of an extract of an enzymatically-treated flower of a *Nicotiana* species. Exemplary extraction solvents include hydrocarbons such as heptane and hexane.

In an aspect, a process such as is described in various embodiments herein provides a material for use in a smoking article or a smokeless tobacco composition comprising an additive derived from one or more flowers of a *Nicotiana* species such as described herein. For example a process such as is described in various embodiments herein provides a material wherein an additive is in the form of a casing formulation or a top dressing formulation applied to tobacco strip or wherein an additive is added to a reconstituted tobacco material. Smoking articles or smokeless tobacco compositions incorporating a flower additive derived from a process such as is described in various embodiments herein may comprise between about 5 ppm and about 5 weight percent of flower additive based on total dry weight of tobacco material in the smoking article or smokeless tobacco product.

In an aspect, a process such as is described in various embodiments herein provides a method for preparing an additive derived from a flower of a *Nicotiana* species for addition to a tobacco composition, the method comprising: i) receiving a harvested flower or a portion thereof; ii) processing the harvested flower or portion thereof by at least one of subdividing the harvested flower or portion thereof to form a particulate flower material or separating a flower derivative from the harvested flower by subjecting the harvested flower or a portion thereof to solvent extraction, chromatography, distillation, filtration, recrystallization, solvent-solvent partitioning, or a combination thereof; and iii) adding the particulate flower material or flower derivative produced in step ii) to a tobacco composition adapted for use in a smoking article or a smokeless tobacco composition.

In an aspect, a process such as is described in various embodiments herein provides a method for preparing an additive derived from a flower of a *Nicotiana* species for addition to a tobacco composition, the method comprising separating a flower derivative from a flower of the *Nicotiana* species, said separating step comprising one or more of the following steps: i) collecting vapor-phase components from the headspace surrounding a living flower; and ii) isolating components of a harvested flower by subjecting the harvested flower or a portion thereof to solvent extraction, chromatography, distillation, filtration, recrystallization, solvent-solvent partitioning, or a combination thereof.

DETAILED DESCRIPTION

Figure 1:
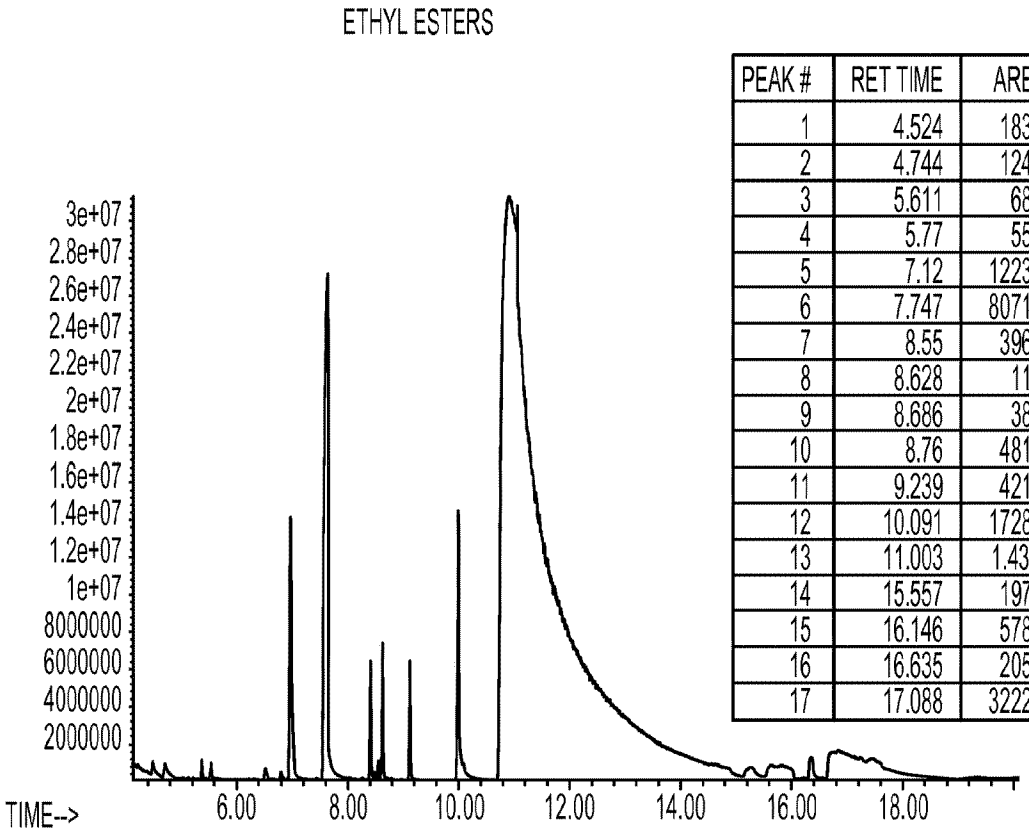
FIG. 1 shows a GC-MS chromatogram of purified ethyl ester material produced by a process such as is described in various embodiments herein.

A process such as is described in various embodiments herein now will be described more fully hereinafter. A process such as is described in various embodiments herein may, however, be embodied in many different forms and should not be construed as limited to the embodiments set forth herein; rather, these embodiments are provided so that this disclosure will be thorough and complete, and will fully convey the scope of a process such as is described in various embodiments herein to those skilled in the art. As used in this specification and the claims, the singular forms "a," "an," and "the" include plural referents unless the context clearly dictates otherwise. Reference to "dry weight percent" or "dry weight basis" refers to weight on the basis of dry ingredients (i.e., all ingredients except water). When used in this specification and the claims as an adjective rather than a preposition, "about" means "approximately" and comprises the stated value and every value within 10% of that value; in other words, "about 100%" includes 90% and 110% and every value in between.

The selection of the plant from a *Nicotiana* species can vary; and in particular, the types of tobacco or tobaccos may vary. Tobaccos that can be employed include flue-cured or Virginia (e.g., K326), burley, sun-cured (e.g., Indian Kurnool and Oriental tobaccos, including Katerini, Prelip, Komotini, Xanthi and Yambol tobaccos), Maryland, dark, dark-fired, dark air cured (e.g., Passanda, Cubano, Jatin and Bezuki tobaccos), light air cured (e.g., North Wisconsin and *Galpao* tobaccos), Indian air cured, Red Russian and *Rustica* tobaccos, as well as various other rare or specialty tobaccos. Descriptions of various types of tobaccos, growing practices and harvesting practices are set forth in Tobacco Production, Chemistry and Technology, Davis et al. (Eds.) (1999), which is incorporated herein by reference. Various representative types of plants from the *Nicotiana* species are set forth in Goodspeed, The Genus *Nicotiana* (Chronica Botanica, 1954); U.S. Pat. No. 4,660,577 to Sensabaugh, Jr. et al.; U.S. Pat. No. 5,387,416 to White et al.; U.S. Pat. No. 7,025,066 to Lawson et al.; U.S. Pat. No. 7,798,153 to Lawrence, Jr.; and U.S. Pat. No. 8,186,360 to Marshall et al., each of which is incorporated herein by reference. Of particular interest are *N. alata, N. arentsii, N. excelsior, N. forgetiana, N. glauca, N. glutinosa, N. gossei, N. kawakamii, N. knightiana, N. langsdorffi, N. otophora, N. setchelli, N. sylvestris, N. tomentosa, N. tomentosiformis, N. undulata*, and *N. x sanderae*. Also of interest are *N. africana, N. amplexicaulis, N. benavidesii, N. bonariensis, N. debneyi, N. longiflora, N. maritina, N. megalosiphon, N. occidentalis, N. paniculata, N. plumbaginifolia, N. raimondii, N. rosulata, N. rustica, N. simulans, N. stocktonii, N. suaveolens, N. tabacum, N. umbratica, N. velutina*, and *N. wigandioides*. Other plants from the *Nicotiana* species include *N. acaulis, N. acuminata, N. attenuata, N. benthamiana, N. cavicola, N. clevelandii, N. cordifolia, N. corymbosa, N. fragrans, N. goodspeedii, N. linearis, N. miersii, N. nudicaulis, N. obtusifolia, N. occidentalis* subsp. *Hersperis, N. pauciflora, N. petunioides, N. quadrivalvis, N. repanda, N. rotundifolia, N. solanifolia* and *N. spegazzinii.*

*Nicotiana* species can be derived using genetic-modification or crossbreeding techniques (e.g., tobacco plants can be genetically engineered or crossbred to increase or decrease production of certain components or to otherwise change certain characteristics or attributes). See, for example, the types of genetic modifications of plants set forth in U.S. Pat. No. 5,539,093 to Fitzmaurice et al.; U.S. Pat. No. 5,668,295 to Wahab et al.; U.S. Pat. No. 5,705,624 to Fitzmaurice et al.; U.S. Pat. No. 5,844,119 to Weigl; U.S. Pat. No. 6,730,832 to Dominguez et al.; U.S. Pat. No. 7,173,170 to Liu et al.; U.S. Pat. No. 7,208,659 to Colliver et al.; and U.S. Pat. No. 7,230,160 to Benning et al.; US Patent Appl. Pub. No. 2006/0236434 to Conkling et al.; and PCT WO 08/103935 to Nielsen et al.

For the preparation of smokeless and smokable tobacco products, it is typical for harvested plants of a *Nicotiana* species to be subjected to a curing process. Descriptions of various types of curing processes for various types of tobaccos are set forth in Tobacco Production, Chemistry and Technology, Davis et al. (Eds.) (1999). Exemplary techniques and conditions for curing flue-cured tobacco are set forth in Nestor et al., Beitrage Tabakforsch. Int., 20, 467-475 (2003) and U.S. Pat. No. 6,895,974 to Peele, which are incorporated herein by reference. See, also, for example, U.S. Pat. No. 7,650,892 to Groves et al., which is incorporated herein by reference. Representative techniques and conditions for air curing tobacco are set forth in Roton et al., Beitrage Tabakforsch. Int., 21, 305-320 (2005) and Staaf et al., Beitrage Tabakforsch. Int., 21, 321-330 (2005), which are incorporated herein by reference. Certain types of tobaccos can be subjected to alternative types of curing processes, such as fire curing or sun curing. Preferably, harvested tobaccos that are cured are then aged.

At least a portion of the plant of a *Nicotiana* species (e.g., at least a portion of the tobacco portion) can be employed in an immature form. That is, the plant, or at least one portion of that plant, can be harvested before reaching a stage normally regarded as ripe or mature. As such, for example, tobacco can be harvested when the tobacco plant is at the point of a sprout, is commencing leaf formation, is commencing seeding, is commencing flowering, or the like.

At least a portion of the plant of a *Nicotiana* species (e.g., at least a portion of the tobacco portion) can be employed in a mature form. That is, the plant, or at least one portion of that plant, can be harvested when that plant (or plant portion) reaches a point that is traditionally viewed as being ripe, over-ripe or mature. As such, for example, through the use of tobacco harvesting techniques conventionally employed by farmers, Oriental tobacco plants can be harvested, burley tobacco plants can be harvested, or Virginia tobacco leaves can be harvested or primed by stalk position. After harvest, a plant of a *Nicotiana* species, or portion thereof, can be used in a green form (e.g., tobacco can be used without being subjected to any curing process). For example, tobacco in green form can be frozen, freeze-dried, subjected to irradiation, yellowed, dried, cooked (e.g., roasted, fried or boiled), or otherwise subjected to storage or treatment for later use. Such tobacco also can be subjected to aging conditions.

In accordance with a process such as is described in various embodiments herein, a tobacco product may incorporate tobacco that is combined with some form of biomass or one or more anatomical parts, such as a flower, obtained from, or derived from, a plant of at least one *Nicotiana* species. That is, a portion of a tobacco product according to a process such as is described in various embodiments herein can be composed of some form of biomass or one or more anatomical parts of a *Nicotiana* species, such as parts or pieces of biomass or one or more anatomical parts, or processed materials incorporating processed biomass or one or more anatomical parts or components thereof, such as a flower or one or more parts thereof. At least a portion of the tobacco product can be composed of components of biomass or one or more anatomical parts, such as a flower, such as ingredients removed from biomass or one or more anatomical parts, such as a flower (e.g., by extraction, distillation, or other types of processing techniques). At least a portion of the tobacco product can be composed of components derived from biomass or one or more anatomical parts, such as a flower, such as components collected after subjecting biomass or one or more anatomical parts to chemical reaction or after subjecting components collected from biomass or one or more anatomical parts, such as a flower, to chemical reaction (e.g., acid/base reaction conditions or enzymatic treatment).

A flower is a characteristic reproductive structure (e.g., seed producing structure) of a plant of a *Nicotiana* species. For example, a tobacco flower is the flower characteristic of a tobacco plant. Flowers of various types of representative *Nicotiana* species are depicted in, Schiltz et al., Les Plantes du G. *Nicotiana* en Collection a L'Institut du Tabac de Bergerac, 2nd Ed. (Seita) (1991).

A *Nicotiana* species can be selected for the type of biomass or anatomical part that it produces. For example, plants can be selected on the basis that those plants produce relatively abundant biomass or seed, produce biomass or seed that incorporate relatively high levels of specific desired components, and the like.

A *Nicotiana* species of plant can be grown under agronomic conditions so as to promote development of biomass or one or more anatomical parts. Tobacco plants can be grown in greenhouses, growth chambers, or outdoors in fields, or grown hydroponically.

According to a process such as is described in various embodiments herein, biomass or one or more anatomical parts, such as a flower, are harvested from a *Nicotiana* species of plant. The manner by which biomass or one or more anatomical parts are harvested can vary. Typically, essentially all the biomass or anatomical parts, such as a flower, can be harvested, and employed as such.

A flower can be harvested from a *Nicotiana* species of plant. The manner by which a flower is harvested can vary. Harvest of flowers traditionally has been referred to as "picking" As such, a flower is removed from the rest of the plant by cutting or breaking the stem or pedicle that connects the flower from the rest of the plant. Alternatively, components of a flower can be derived by collecting vapor-phase components from the headspace in the vicinity of a living flower (i.e., a flower that has not been removed or picked from the plant), such as by capturing vapor-phase components from the headspace of a growth chamber containing a living flower.

Any one or more of various parts or portions of a flower can be employed. For example, virtually all of a flower (e.g., the whole flower) can be harvested, and employed as such. Alternatively, various parts or pieces of a flower can be harvested or separated for further use after harvest. For example, a petal, corolla, sepal, receptacle, anther, filament, stigma, stamen, style, pistil, pedicel, ovary, or any of various combinations thereof can be derived for further use or treatment.

Time of harvest during the life cycle of the plant can vary. For example, biomass or one or more anatomical parts, such as a flower, can be harvested when immature. Alternatively, biomass or one or more anatomical parts, such as a flower or a seed, can be harvested after the point that the plant has reached maturity.

With respect to a flower, time of harvest during the life cycle of the flower can vary. For example, a flower can be harvested when it is in the form of a bud, when it is closed prior to bloom, during bloom, or after bloom is complete. Timing of harvest can affect yield of certain desirable compounds derived from a flower, with harvesting late in a growing season toward the end of the plant life being less preferred.

A flower can be harvested at any of various times of day. For example, a flower can be harvested during morning hours or afternoon hours (i.e., during daylight hours), or at nighttime (i.e., when it is dark). A flower can be harvested when it is dry, or when it is wet (e.g., after being exposed to rain or irrigation).

Post-harvest processing of biomass or one or more anatomical parts, such as a flower or a seed, can vary. After harvest, the biomass or one or more anatomical parts, such as a flower or a seed, or portion thereof, can be used in the harvested form (e.g., the biomass or one or more anatomical parts, such as a flower or a seed, or portion thereof, can be used without being subjected to any curing and/or aging process steps). For example, biomass or one or more anatomical parts, such as a flower or a seed, can be used without being subjected to significant storage, handling or processing conditions. In certain situations, it is preferable that fresh biomass or one or more anatomical parts, such as a flower or a seed, be used virtually immediately after harvest. Alternatively, for example, biomass or one or more anatomical parts, such as a flower or a seed, for example, a flower in green form, can be refrigerated or frozen for later use, freeze dried, subjected to irradiation, yellowed, dried, cured (e.g., using air drying techniques or techniques that employ application of heat), heated or cooked (e.g., roasted, fried or boiled), or otherwise subjected to storage or treatment for later use.

Harvested biomass, such as a flower or a seed, can be physically processed. Biomass or one or more anatomical parts, or one or more parts thereof, can be further subdivided into parts or pieces (e.g., biomass can be comminuted, pulverized, milled or ground into pieces or parts that can be characterized as granules, particulates or fine powders, or, e.g., petals can be removed from remaining portion of a flower). Biomass or one or more anatomical parts, such as a flower or a seed, or one or more parts thereof, can be subjected to external forces or pressure (e.g., by being pressed or subjected to roll treatment). When carrying out such processing conditions, biomass or one or more anatomical parts, such as a flower or a seed, can have a moisture content that approximates its natural moisture content (e.g., its moisture content immediately upon harvest), a moisture content achieved by adding moisture to the biomass, such as a flower or a seed, or a moisture content that results from the drying of the biomass, such as a flower or a seed. For example, powdered, pulverized, ground or milled pieces of biomass or one or more anatomical parts, such as a flower or a seed, can have moisture contents of less than about 25 weight percent, often less than about 20 weight percent, and frequently less than about 15 weight percent. Parts or pieces of biomass or one or more anatomical parts, such as a flower or a seed, can be used as components of tobacco products without further processing, or alternatively the particulate biomass or anatomical part material can be processed further prior to incorporation into a tobacco product.

Harvested biomass or one or more anatomical parts, such as a flower or a seed, or components thereof, can be subjected to other types of processing conditions. For example, components of biomass or one or more anatomical parts, such as a flower or a seed, can be separated from one another, or otherwise fractionated into chemical classes or mixtures of individual compounds. As used herein, an "isolated biomass component," "isolated component of one or more anatomical parts," "biomass isolate," "isolate of one or more anatomical parts," or "isolate" when used as a noun is a compound or complex mixture of compounds separated from biomass or one or more anatomical parts, such as a flower or a seed, of a plant of a *Nicotiana* species. Accordingly, a "flower isolate" is a compound or complex mixture of compounds derived from a flower of a plant of a *Nicotiana* species. The isolated biomass component or isolated component of one or more anatomical parts, such as a flower or a seed, can be a single compound, a homologous mixture of similar compounds (e.g., isomers of a flavorful or aromatic compound), or a heterologous mixture of dissimilar compounds (e.g., a complex mixture of various compounds of different types, preferably having desirable sensory attributes).

Typical separation processes can include one or more process steps such as solvent extraction (e.g., using polar solvents, non-polar organic solvents, or supercritical fluids), chromatography, distillation, filtration, cold pressing or other pressure-based techniques, recrystallization, and/or solvent-solvent partitioning. Exemplary extraction and separation solvents or carriers include water, alcohols (e.g., methanol or ethanol), hydrocarbons (e.g., heptane and hexane), diethyl ether, methylene chloride and supercritical carbon dioxide. Exemplary techniques useful for extracting components from *Nicotiana* species are described in U.S. Pat. No. 4,144,895 to Fiore; U.S. Pat. No. 4,150,677 to Osborne, Jr. et al.; U.S. Pat. No. 4,267,847 to Reid; U.S. Pat. No. 4,289,147 to Wildman et al.; U.S. Pat. No. 4,351,346 to Brummer et al.; U.S. Pat. No. 4,359,059 to Brummer et al.; U.S. Pat. No. 4,506,682 to Muller; U.S. Pat. No. 4,589,428 to Keritsis; U.S. Pat. No. 4,605,016 to Soga et al.; U.S. Pat. No. 4,716,911 to Poulose et al.; U.S. Pat. No. 4,727,889 to Niven, Jr. et al.; U.S. Pat. No. 4,887,618 to Bernasek et al.; U.S. Pat. No. 4,941,484 to Clapp et al.; U.S. Pat. No. 4,967,771 to Fagg et al.; U.S. Pat. No. 4,986,286 to Roberts et al.; U.S. Pat. No. 5,005,593 to Fagg et al.; U.S. Pat. No. 5,018,540 to Grubbs et al.; U.S. Pat. No. 5,060,669 to White et al.; U.S. Pat. No. 5,065,775 to Fagg; U.S. Pat. No. 5,074,319 to White et al.; U.S. Pat. No. 5,099,862 to White et al.; U.S. Pat. No. 5,121,757 to White et al.; U.S. Pat. No. 5,131,414 to Fagg; U.S. Pat. No. 5,131,415 to Munoz et al;. U.S. Pat. No. 5,148,819 to Fagg; U.S. Pat. No. 5,197,494 to Kramer; U.S. Pat. No. 5,230,354 to Smith et al.; U.S. Pat. No. 5,234,008 to Fagg; U.S. Pat. No. 5,243,999 to Smith; U.S. Pat. No. 5,301,694 to Raymond et al.; U.S. Pat. No. 5,318,050 to Gonzalez-Parra et al.; U.S. Pat. No. 5,343,879 to Teague; U.S. Pat. No. 5,360,022 to Newton; U.S. Pat. No. 5,435,325 to Clapp et al.; U.S. Pat. No. 5,445,169 to Brinkley et al.; U.S. Pat. No. 6,131,584 to Lauterbach; U.S. Pat. No. 6,298,859 to Kierulff et al.; U.S. Pat. No. 6,772,767 to Mua et al.; and U.S. Pat. No. 7,337,782 to Thompson, each of which is incorporated herein by reference. See also, the types of separation techniques set forth in Brandt et al., LC-GC Europe, p. 2-5 (March, 2002) and Wellings, A Practical Handbook of Preparative HPLC (2006), which are incorporated herein by reference. In addition, the biomass or components thereof can be subjected to the types of treatments set forth in Ishikawa et al., Chem. Pharm. Bull., 50, 501-507 (2002); Tienpont et al., Anal. Bioanal. Chem., 373, 46-55 (2002); Ochiai, Gerstel Solutions Worldwide, 6, 17-19 (2006); Coleman, III, et al., J. Sci. Food and Agric., 84, 1223-1228 (2004); Coleman, III et al., J. Sci. Food and Agric., 85, 2645-2654 (2005); Pawliszyn, ed., Applications of Solid Phase Microextraction, RSC Chromatography Monographs, (Royal Society of Chemistry, UK) (1999); Sahraoui et al., J. Chrom., 1210, 229-233 (2008); and U.S. Pat. No. 5,301,694 to Raymond et al., each of which is incorporated herein by reference. See also, for example, the types of processing techniques set forth in Frega et al., JAOCS, 68, 29-33 (1991); Patel et al., Tob. Res., 24, 44-49 (1998); Giannelos et al., Ind. Crops Prod., 16, 1-9 (2002); Mukhtar et al., Chinese J. Chem., 25, 705-708 (2007); and Stanisavljevic et al., Eur. J. Lipid Sci. Technol., 111, 513-518 (2009), each of which is incorporated herein by reference.

Any one or more components of a flower, or any one or more portions of a flower, can be isolated. As used herein, an "isolated component" or "flower isolate" is a compound or complex mixture of compounds separated from a flower of a plant of a *Nicotiana* species. An isolated component can be a single compound, a homologous mixture of similar compounds (e.g., isomers of a flavor compound), or a heterologous mixture of dissimilar compounds (e.g., a complex mixture of various compounds of different types, preferably having desirable sensory attributes). Likewise, any one or more components of a seed, or any one or more portions of a seed, can be isolated. As used herein, an "isolated component" or "seed isolate" is a compound or complex mixture of compounds separated from a seed of a plant of a *Nicotiana* species. An isolated component can be a single compound, a homologous mixture of similar compounds (e.g., isomers of a flavor compound), or a heterologous mixture of dissimilar compounds (e.g., a complex mixture of various compounds of different types, preferably having desirable sensory attributes). Accordingly, an "isolate" according to a process such as is described in various embodiments herein may be a flower isolate, a seed isolate, or, more generally, a biomass isolate.

Multiple sequential separation processes can be employed to purify and refine a flower isolate or a seed isolate in a desired manner. For example, a solvent extract of a flower or of a seed of a *Nicotiana* species can be subjected to additional separation steps to change the chemical composition of the extract, such as by increasing the relative amount of certain desirable compounds, such as certain flavorful or aromatic compounds. In one embodiment, a flower extract or a seed extract is processed using molecular distillation, which typically involves vacuum distillation at a pressure of less than about 0.01 Torr.

Examples of types of components that can be present in isolates include terpenes, sesqui-terpenes, diterpenes, esters (e.g., terpenoid esters and fatty acid esters), alcohols, aldehydes, ketones, carboxylic acids, lactones, anhydrides, phenols quinones, ethers, nitriles, amines, amides, imides, nitroalkanes, nitrophenols, nitroarenes, nitrogen-containing heterocyclics, lactams, oxazoles, aza-arenes, sulfur-containing compounds, alkaloids (e.g., nicotine), plastid pigments (e.g., chlorophylls or carotenoids), lipids (e.g., phytosterols), and derivatives thereof. Additional examples of representative components that can be employed are described as natural tar diluents in PCT WO 2007/012980 to Lipowicz, which is incorporated herein by reference.

Any one or more components of a flower or a seed can be subjected to conditions so as to cause those components (whether as part of the flower or of the seed or in the form of an isolated component) to undergo chemical transformation. For example, flower isolates that have been separated from the flower can be treated to cause chemical transformation or be admixed with other ingredients. The chemical transformations or modification of the flower isolate can result in changes of certain chemical and physical properties of those flower isolates (e.g., the sensory attributes of those isolates). For example, seed isolates that have been separated from the seed can be treated to cause chemical transformation or be admixed with other ingredients. The chemical transformations or modification of the seed isolate can result in changes of certain chemical and physical properties of those seed isolates (e.g., the sensory attributes of those isolates). Exemplary chemical modification processes can be carried out by acid/base reaction, hydrolysis, heating (e.g., a thermal treatment where the flower isolate is subjected to an elevated temperature such as a temperature of at least about 50 degrees Celsius, or at least about 75 degrees Celsius, or at least about 90 degrees Celsius), and enzymatic treatments (e.g., using glycosidase or glucocidase); and as such, components of the flower isolate can undergo esterification, transesterification, isomeric conversion, acetal formation, acetal decomposition, invert sugar reactions, and the like. Exemplary types of further ingredients that can be admixed with the isolates include flavorants, fillers, binders, pH adjusters, buffering agents, colorants, disintegration aids, antioxidants, humectants and preservatives.

Flowers and components of flower isolates are useful as additives for tobacco compositions, particularly tobacco compositions incorporated into smoking articles or smokeless tobacco products. Addition of one or more flower isolates to a tobacco composition can enhance a tobacco composition in a variety of ways, depending on the nature of the flower isolates and the type of tobacco composition. Exemplary flower isolates can serve to provide flavor and/or aroma to a tobacco product (e.g., composition that alters the sensory characteristics of tobacco compositions or smoke derived therefrom). Likewise, components of seed isolates are useful as additives for tobacco compositions, particularly tobacco compositions incorporated into smoking articles or smokeless tobacco products. Addition of one or more seed isolates to a tobacco composition can enhance a tobacco composition in a variety of ways, depending on the nature of the seed isolates and the type of tobacco composition. Exemplary seed isolates can serve to provide flavor and/or aroma to a tobacco product (e.g., composition that alters the sensory characteristics of tobacco compositions or smoke derived therefrom).

A variety of compounds having distinctive flavor and aroma characteristics can be isolated from flowers or seeds or, more generally, from biomass of plants of *Nicotiana* species. Certain of those compounds can be considered to be volatile under normal ambient conditions of temperature, humidity and air pressure. Preferred compounds exhibit positive sensory attributes at relatively low concentrations. For example, a suitable flower can provide compounds such as 4-ketosiophorone, phytol, phenethyl alcohol, benzyl alcohol, linalool, various cembrenol isomers, various cembrenediols, isophorone, methylbenzoate, salicylaldehyde, benzylsalicylate, methoxy eugenol, thunbergol, various carboxylic acids, various oximes, benzaldehyde, benzylbenzoate, scaral, acetophenone, caryophyllene, cinnamaldehyde, cinnamyl alcohol, various cyclohexene-butanone isomers, solavetivone, farnesol, farnesol, and the like. Additional exemplary compounds include 1,8-cineole, cis-3-hexen-1-ol, methylsalicylate, b-ionone, acetovanillone, b-damascone, b-damascenone, dihydroactinidiolide, vanillylacetone, sclareolide, sclareol, cis-abienol, cembrene isomers, cembratriene diol isomers (e.g., .alpha.-cembratriendiol, .beta.-cembratrienediol), megastigmatrienones, norsolanadione, solanone, caryophyllene oxide, ionol derivatives, and the like. Each of those types of compounds can be isolated in relatively pure form. See, for example, Raguso et al., Phytochemistry, 63, 265-284 (2003) and Bauer et al., Common Fragrance and Flavor Materials, Preparation, Properties and Uses, VCH, Federal Republic of Germany (1985). In addition, compounds having distinctive flavor and aroma characteristics can be chemically bound, such as in the form of glycosidically bound compounds. Many different compounds of interest can be present in tobacco flowers in a glycoside form, such as benzaldehyde, benzyl alcohol, phenethyl alcohol, ethyl acetophenone, 4-ketoisopherone, benzyl acetate, 1,8-cineol, linalool, geraniol, eugenol, nerolidol, cembrenediols, terpineol, megastigmatrienones, and other compounds noted herein. See, for example, Snook et al., Phytochemistry, 31, 1639-1647 (1992); Loughrin et al., Phytochemistry, 31, 1537-1540 (1992); Kodama et al., Agric. Biol. Chem., 45, 941-944 (1981); Matsumura et al., Chem. Pharm. Bull., 50, 66-72 (2002); and Ishikawa et al., Chem. Pharm. Bull., 50, 501-507 (2002).

The form of an isolate can vary. Typically, an isolate is in a solid, liquid, or semi-solid or gel form. An isolate can be used in concrete, absolute, or neat form. Solid forms of an isolate include spray-dried and freeze-dried forms. Liquid forms of an isolate include isolates contained within aqueous or organic solvent carriers.

A flower, a processed flower or a flower isolate, or a seed, a processed seed or a seed isolate, can be employed in any of a variety of forms. A harvested flower or flower isolate or harvested seed or seed isolate can be employed as a component of processed tobaccos. In one regard, a flower, or any one or more components thereof, or a seed, or any one or more components thereof, can be employed within a casing formulation for application to tobacco strip (e.g., using the types of manners and methods set forth in U.S. Pat. No. 4,819,668 to Shelar, which is incorporated herein by reference) or within a top dressing formulation. Alternatively, a flower, or any one or more components thereof, or a seed, or any one or more components thereof, can be employed as an ingredient of a reconstituted tobacco material (e.g., using the types of tobacco reconstitution processes generally set forth in U.S. Pat. No. 5,143,097 to Sohn; U.S. Pat. No. 5,159,942 to Brinkley et al.; U.S. Pat. No. 5,598,868 to Jakob; U.S. Pat. No. 5,715,844 to Young; U.S. Pat. No. 5,724,998 to Gellatly; and U.S. Pat. No. 6,216,706 to Kumar, which are incorporated herein by reference). A flower, or any one or more components thereof, or a seed, or any one or more components thereof, also can be incorporated into a cigarette filter (e.g., in the filter plug, plug wrap, or tipping paper) or incorporated into cigarette wrapping paper, preferably on the inside surface, during the cigarette manufacturing process.

A flower, processed flower or flower isolate, or a seed, processed seed or seed isolate, can be incorporated into smoking articles. Representative tobacco blends, non-tobacco components, and representative cigarettes manufactured therefrom, are set forth in U.S. Pat. No. 4,836,224 to Lawson et al.; U.S. Pat. No. 4,924,888 to Perfetti et al.; U.S. Pat. No. 5,056,537 to Brown et al.; U.S. Pat. No. 5,220,930 to Gentry; and U.S. Pat. No. 5,360,023 to Blakley et al.; US Pat. Application 2002/0000235 to Shafer et al.; and PCT WO 02/37990. Those tobacco materials also can be employed for the manufacture of those types of cigarettes that are described in U.S. Pat. No. 4,793,365 to Sensabaugh; U.S. Pat. No. 4,917,128 to Clearman et al.; U.S. Pat. No. 4,947,874 to Brooks et al.; U.S. Pat. No. 4,961,438 to Korte; U.S. Pat. No. 4,920,990 to Lawrence et al.; U.S. Pat. No. 5,033,483 to Clearman et al.; U.S. Pat. No. 5,074,321 to Gentry et al.; U.S. Pat. No. 5,105,835 to Drewett et al.; U.S. Pat. No. 5,178,167 to Riggs et al.; U.S. Pat. No. 5,183,062 to Clearman et al.; U.S. Pat. No. 5,211,684 to Shannon et al.; U.S. Pat. No. 5,247,949 to Deevi et al.; U.S. Pat. No. 5,551,451 to Riggs et al.; U.S. Pat. No. 5,285,798 to Banerjee et al.; U.S. Pat. No. 5,593,792 to Farrier et al.; U.S. Pat. No. 5,595,577 to Bensalem et al.; U.S. Pat. No. 5,816,263 to Counts et al.; U.S. Pat. No. 5,819,751 to Barnes et al.; U.S. Pat. No. 6,095,153 to Beven et al.; U.S. Pat. No. 6,311,694 to Nichols et al.; and U.S. Pat. No. 6,367,481 to Nichols, et al.; US Pat. Appl. Pub. No. 2008/0092912 to Robinson et al.; and PCT WO 97/48294 and PCT WO 98/16125. See, also, those types of commercially marketed cigarettes described Chemical and Biological Studies on New Cigarette Prototypes that Heat Instead of Burn Tobacco, R. J. Reynolds Tobacco Company Monograph (1988) and Inhalation Toxicology, 12:5, p. 1-58 (2000).

A flower, processed flower or flower isolate, or a seed, processed seek or seed isolate, can be incorporated into smokeless tobacco products, such as loose moist snuff, loose dry snuff, chewing tobacco, pelletized tobacco pieces (e.g., having the shapes of pills, tablets, spheres, coins, beads, obloids or beans), extruded or formed tobacco strips, pieces, rods, cylinders or sticks, finely divided ground powders, finely divided or milled agglomerates of powdered pieces and components, flake-like pieces, molded processed tobacco pieces, pieces of tobacco-containing gum, rolls of tape-like films, readily water-dissolvable or water-dispersible films or strips (e.g., US Pat. App. Pub. No. 2006/0198873 to Chan et al.), or capsule-like materials possessing an outer shell (e.g., a pliable or hard outer shell that can be clear, colorless, translucent or highly colored in nature) and an inner region possessing tobacco or tobacco flavor (e.g., a Newtonian fluid or a thixotropic fluid incorporating tobacco of some form). Various types of smokeless tobacco products are set forth in U.S. Pat. No. 1,376,586 to Schwartz; U.S. Pat. No. 3,696,917 to Levi; U.S. Pat. No. 4,513,756 to Pittman et al.; U.S. Pat. No. 4,528,993 to Sensabaugh, Jr. et al.; U.S. Pat. No. 4,624,269 to Story et al.; U.S. Pat. No. 4,987,907 to Townsend; U.S. Pat. No. 5,092,352 to Sprinkle, III et al.; and U.S. Pat. No. 5,387,416 to White et al.; US Pat. App. Pub. Nos. U.S. Pat. No. 2005/0244521 to Strickland et al. and U.S. Pat. No. 2008/0196730 to Engstrom et al.; PCT WO 04/095959 to Arnarp et al.; PCT WO 05/063060 to Atchley et al.; PCT WO 05/016036 to Bjorkholm; and PCT WO 05/041699 to Quinter et al., each of which is incorporated herein by reference. See also, the types of smokeless tobacco formulations, ingredients, and processing methodologies set forth in U.S. Pat. No. 6,953,040 to Atchley et al. and U.S. Pat. No. 7,032,601 to Atchley et al.; US Pat. Appl. Pub. Nos. 2002/0162562 to Williams; 2002/0162563 to Williams; 2003/0070687 to Atchley et al.; 2004/0020503 to Williams, 2005/0178398 to Breslin et al.; 2006/0191548 to Strickland et al.; 2007/0062549 to Holton, Jr. et al.; 2007/0186941 to Holton, Jr. et al.; 2007/0186942 to Strickland et al.; 2008/0029110 to Dube et al.; 2008/0029116 to Robinson et al.; 2008/0029117 to Mua et al.; 2008/0173317 to Robinson et al.; and 2008/0209586 to Nielsen et al., each of which is incorporated herein by reference.

An amount of a flower or a flower isolate, or of a seed or a seed isolate, added to a tobacco composition, or otherwise incorporated within a tobacco composition or tobacco product, can depend on the desired function of that flower or seed component, the chemical makeup of that component, and the type of tobacco composition to which the flower or seed component is added. The amount added to a tobacco composition can vary, but will typically not exceed about 5 weight percent based on the total dry weight of the tobacco composition to which the flower or flower isolate or seed or seed isolate is added. When the flower is employed within a smoking article, the amount of flower will typically be at least about 5 ppm, generally at least about 10 ppm, and often at least about 100 ppm, based on the total dry weight of the tobacco material within the smoking article; but will typically be less than about 5 percent, generally less than 2 percent, and often less than about 1 percent, based on the total dry weight of the tobacco material within the smoking article. When the flower is employed within a smokeless tobacco product, the amount of flower will typically be less at least about 5 ppm, generally at least about 10 ppm, and often at least about 100 ppm, based on the total dry weight of the tobacco material within the smokeless tobacco product; but will typically be less than about 5 percent, generally less than 2 percent, and often less than about 1 percent, based on the total dry weight of the tobacco material within the smokeless tobacco product.

Aspects of a process such as is described in various embodiments herein are further illustrated by the following examples, which are set forth to illustrate certain aspects of a process such as is described in various embodiments herein and are not to be construed as limiting thereof.

A flower absolute of *Nicotiana alata* contains a large quantity of octanoic acid (approximately 32% isolated yield) along with other $C_5$ to $C_{12}$ acids in smaller percentages. These compounds are sensory neutral or sensory negative. Through esterification these compounds were transformed to sensory positive compounds.

Utilizing Fisher Esterification

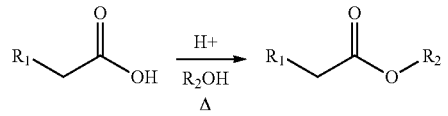

$R_1$ = $C_1$-$C_{10}$ (linear or branched)
$R_2$ = ethyl, isopropyl, isoamyl a process was developed to synthesize esters of the aforementioned naturally occurring acids isolated from a *N. alata* flower absolute. The process was scaled-up to yield quantities of purified product.

*Nicotiana* flowers are, according to a process such as is descried in various embodiments herein, a source of compounds with positive sensory characteristics. Flash chromatography to separate the flower absolutes of *N. sylvestris, N. suaveolens*, and *N. alata*. In the case of *N. alata*, the major isolated constituent was octanoic acid with trace quantities of other $C_5$-$C_{12}$ acids. These compounds are sensory neutral or sensory negative (shorter chain acids have cheesy, sweaty socks aroma while $C_8$ and larger have no aroma). In contrast, the ethyl esters of these acids have very positive sensory characteristics: fruity pineapple, strawberry, apple, banana, coconut, wine, cognac, rum. Furthermore, these esters are very powerful with odor thresholds as low as 1 part per billion.

Initial studies dealt with screening reaction conditions to determine the optimal parameters for synthesis of ethyl esters. Optimization was guided by conversion of octanoic acid to ethyl octanoate and reaction time.

TABLE 1

Reaction Optimization Trials

| Trial | Acid (molar equivalents) | Ethanol molar equivalents | Additive | Time (h) | Results |
|---|---|---|---|---|---|
| A | HCl (1.7) | 100 | molecular sieves | 24 | no reaction |
| B | $H_2SO_4$ (2.3) | 100 | molecular sieves | 24 | no reaction |

TABLE 1-continued

| Reaction Optimization Trials | | | | | |
|---|---|---|---|---|---|
| Trial | Acid (molar equivalents) | Ethanol molar equivalents | Additive | Time (h) | Results |
| C | $H_2SO_4$ (5.6) | 1000 | n/a | 24 | complete |
| D | $H_2SO_4$ (1.6) | 500 | n/a | 5 | complete |
| E | Dowex 50W X8 | 500 | n/a | 48 | no reaction |

As evident in Table 1, favorable results were obtained in trial D with approximately 1.5 equivalents of concentrated sulfuric acid, 500 equivalents of absolute ethanol, and no molecular sieves for water scavenging.

A subsequent objective was to synthesize a mixture of ethyl esters in a quantity large enough for sensory evaluation. To accomplish this, the starting material acid mixture (5.067 g, 35.1 mmol) was added to a 1-L round bottom flask equipped with a magnetic stir bar and dissolved in absolute ethanol (610 mL, 10.4 mol). After dissolution, concentrated sulfuric acid (3.0 mL, 54.0 mmol) was added to the reaction mixture. The flask was then fitted with a condenser and heated to reflux. After 4 hours an aliquot of the reaction mixture was analyzed by GC-MS and determined to be completely converted to the ethyl esters. The reaction mixture was cooled to ambient temperature and concentrated using a Rocket evaporator to remove a majority of the ethanol (down to 50 mL volume). This concentrate was then poured into a 1-L separatory funnel and diluted with methyl-tert-butyl ether (500 mL). This organic layer was then washed once with a saturated sodium bicarbonate solution (100 mL) and four times with deionized water (4×100 mL). After the final wash the aqueous solution was observed to be neutralized (pH 7), indicating removal of the sulfuric acid catalyst. The organic layer was then dried over anhydrous sodium sulfate and concentrated using a Rocket evaporator.

Crude product (3.822 g) was purified using an Interchim PuriFlash 4250 flash chromatography system. This method employed a silica gel column (24 g, 15 μm particle size) and a hexane/ethyl acetate elution gradient. Fractions that were enriched in ethyl esters (as determined by GC-MS analysis) were then combined and concentrated using the Rocket evaporator to yield a pale yellow oil (1.468 g, 24.6% yield). A GC-MS chromatogram of purified ethyl ester material yielded the data shown in FIG. 1.

A process such as is described in various embodiments herein was further employed to synthesize corresponding isopropyl and isoamyl esters in scaled-up quantity. Esterifications with other alcohols were performed to demonstrate scope of process and to produce other unique sensory positive materials. As seen in Table 2, isopropyl and isoamyl esters of tobacco-derived material were produced by a process such as is described in various embodiments herein.

TABLE 2

| Alternate Esterifications | | | |
|---|---|---|---|
| Trial | Alcohol | Time (h) | % Yield |
| A | Isopropanol | 24 | 16.4 |
| B | Isoamyl alcohol | 4 | 19.8 |

Figure 2:
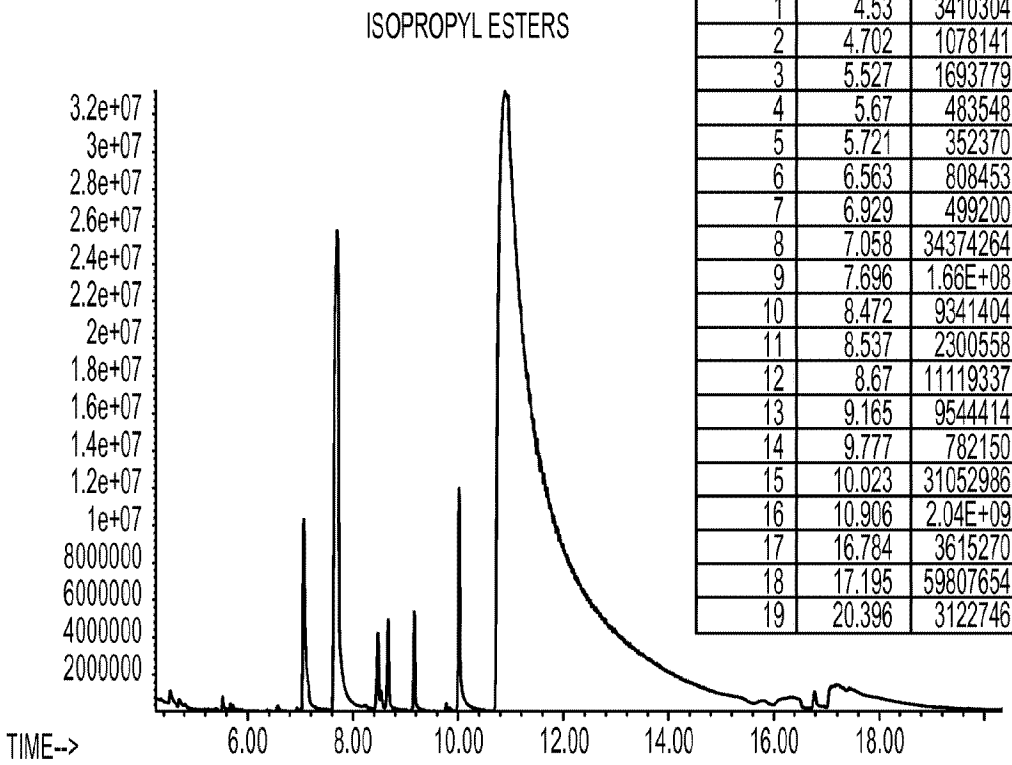
FIG. 2 shows a GC-MS chromatogram of purified isopsopyl ester material produced by a process such as is described in various embodiments herein.
Figure 3:
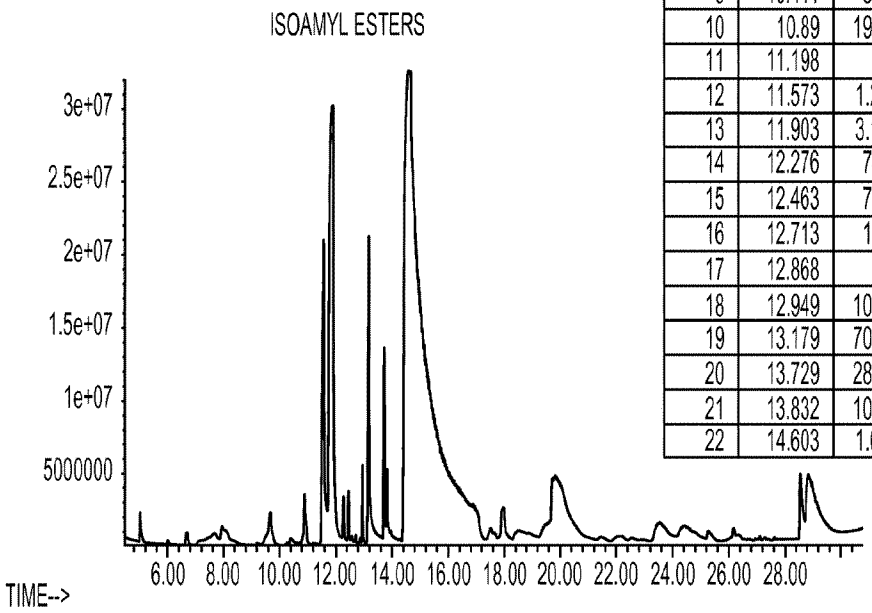
FIG. 3 shows a GC-MS chromatogram of purified isoamyl ester material produced by a process such as is described in various embodiments herein.

A GC-MS chromatogram of purified ethyl isopropyl ester material yielded the data shown in FIG. 2. The GC-MS chromatogram of purified isoamyl ester material yielded the data shown in FIG. 3.

Flash chromatography on a silica gel column was employed to prepare a mixture of acids such as was used in the examples above from an absolute of a *Nicotiana* species. According to such a process, hexane/ethyl acetate solvent gradient facilitated separation of cembratriendiols from target short- to medium-chain aliphatic acids. Such a process yielded successful preparation for *N. alata, N. suaveoloens* and *N. sylvestris*. Flowers were extracted with hexanes at ambient temperature and concentrated to produce a flower concrete. Each concrete was dissolved in a minimal quantity of ethanol and precipitated to precipitate a corresponding wax. Each remaining solution was vacuum filtered to produce a flower absolute. On average, flower absolute constituted 0.12% of wet flower mass.

As working examples of a process such as is described herein in various embodiments, various catalyses were undertaken to effectuate trans-esterification of tobacco oil triglycerides with ethanol to form fatty acid ethyl esters. For example, trans-esterification of tobacco seed oil triglycerides with boron trifluoride in the presence and absence of NaOH was undertaken. To 20 mg of oil in a small vial was added 1 mL of 0.5M NaOH. The vial was purged with $N_2$, capped, and heated for 5 minutes at 95° C. The resulting mixture was then cooled and 2 mL of 10% $BF_3$ in ethanol was added to the solution. The vial was again purged with $N_2$, capped, and heated for an additional 30 minutes at 95° C. Next, the sample was cooled, and most of the ethanol was removed under vacuum. The mixture of fatty acid ethyl ester products was extracted. There was substantial conversion of triglyceride to corresponding fatty acid ethyl ester.

In like manner, sodium ethoxide/boron trifluoride catalysis was undertaken. 1 mL of either 0.5M or 1M NaOEt in ethanol was used with 20 mg of tobacco seed oil. The solution was purged with $N_2$, capped, and heated at 95° C. for 5 minutes. Samples were cooled and a volume (0.5, 1, or 2 mL) of 10% $BF_3$ in ethanol was added to the reaction vessel. In addition to studying the effect of NaOEt on the reaction, three other experiments were performed to determine if a higher concentration of base and/or a higher volume of $BF_3$ would provide a more efficient reaction. Varying the concentration of NaOEt did not have a major effect on conversion of either the $C_{11}$ triglyceride or the various triglycerides in the tobacco seed oil. An increase in the volume of $BF_3$ from 0.5 to 2 mL, however, increased reaction yield. This catalytic method was found to be highly sensitive to trace amounts of moisture. Acceptable results were obtained when only boron trifluoride and not sodium ethoxide was used as catalyst.

Base catalysts such as sodium carbonate, potassium carbonate, sodium hydroxide, and sodium ethoxide were tested for trans-esterification of tobacco seed oil. However, none of these catalysts showed reaction yields greater than 5-10%. These results seemed to contradict reports in the literature, wherein 95% conversion of triglycerides to ethyl esters was observed. See "Trans-Esterification of Vegetable Oils: a Review", U. Schuchardt, R. Sercheli, and R. M. Vargas; J.

Braz. Chem. Soc., 9, 199-210 (1998); "Catalysis in Biodiesel Production by trans-Esterification Processes: An Insight", P. M. Ejikeme, I. D. Anyaogu, L. Ejikeme, N. P. Nwafor, C. A. Egbuonu, and K. Ukogu, E. Journal Chemistry, 7, 1120-1132 (2010). The cited literature emphasized that the reaction must be completed under anhydrous and anaerobic conditions. It is, therefore, possible that some of the poor recoveries were due to either wet tobacco seed oil or the presence of air in the reaction chamber. It was concluded that a trans-esterification reaction which exhibited no notable sensitivity to the presence of moisture could have a distinct advantage. The presence of moisture, however, would be very difficult to control on an industrial production scale.

With respect to acid catalysis, various concentrations of $H_2SO_4$ in ethanol at different temperatures (80° and 100° C.) and different reaction times (1, 3, 8, and 24 hours) were tested. In order to achieve optimized reaction conditions, approximately 20 mg of oil was trans-esterified with 0.5 mL of ethanol containing 3, 5, or 10% $H_2SO_4$. The triglyceride internal standard (2 mg of glyceryl $C_{11}$) was initially added to each reaction mixture. After each trans-esterification, GC/FID was used to estimate the percent conversion of the internal standard to the $C_{11}$ fatty acid ethyl ester. Subsequently, trans-esterification efficiency was determined via both gravimetry and GC/FID analysis. An object was to achieve high purity of fatty acid ethyl ester product. After each reaction, residual ethanol was removed under vacuum and the resulting mixture was washed with 1 mL of saturated NaCl solution. The vacuum-dried mixture of fatty acid ethyl esters was extracted with 3×1 mL of hexane. Next, the hexane containing fatty acid ethyl esters was dried over sodium sulfate, and the hexane was evaporated completely. The combined weight of fatty acid ethyl ester was obtained, then combined fatty acid ethyl esters were dissolved in 10 mL of dichloromethane and individually analyzed via GC/FID. For example, sn 87.8% conversion for glyceryl $C_{11}$ to the corresponding fatty acid ethyl ester was obtained using 3% $H_2SO_4$ in ethanol at 80° C. for 24 hours.

Figure 4:
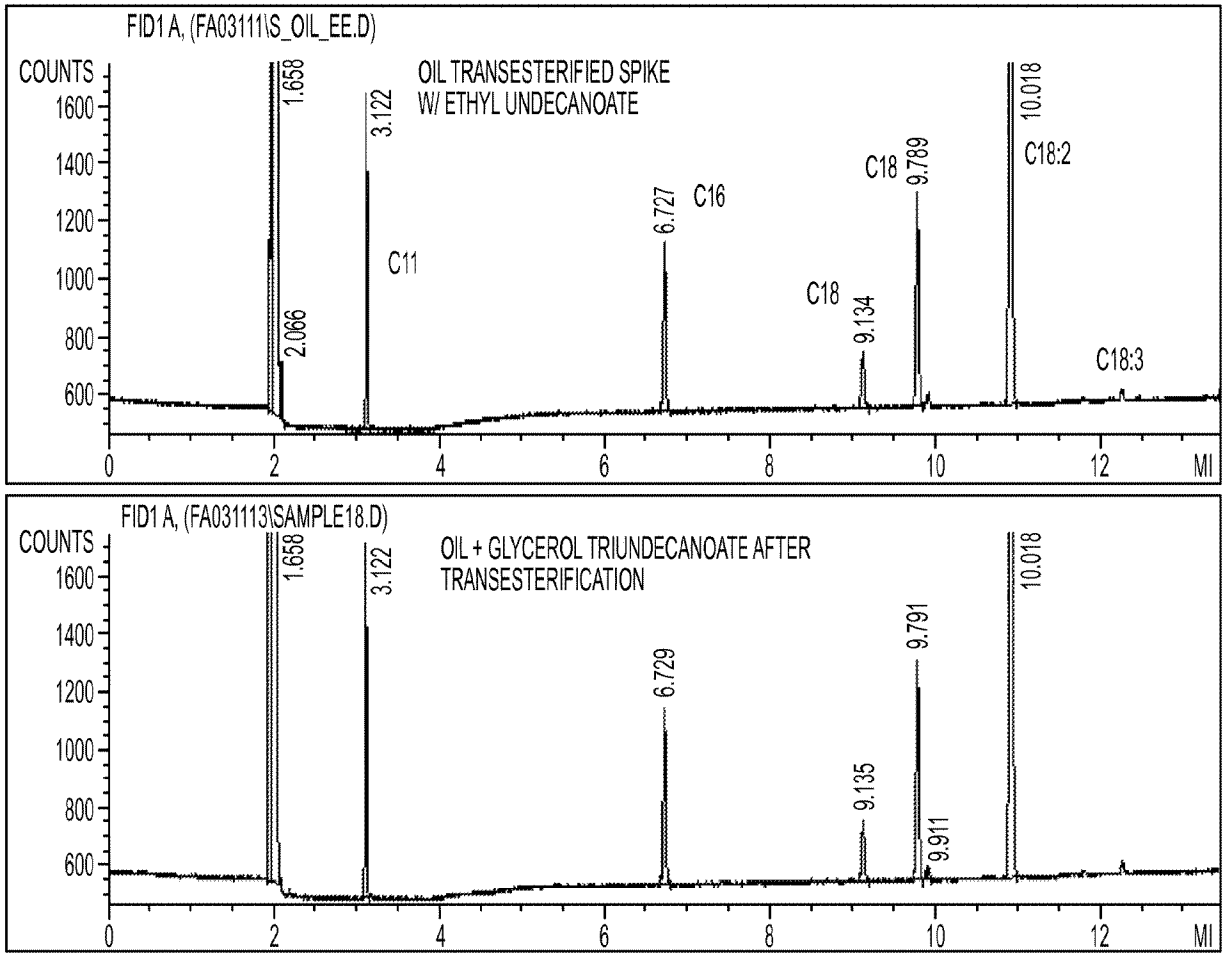
FIG. 4 shows a GC/FID chromatogram of: (A) tobacco seed oil spiked with the glyceryl $C_{11}$ internal standard (2.15 mg) after trans-esterification of the mixture; (B) reaction product of tobacco seed oil trans-esterified then spiked with $C_{11}$ fatty acid ethyl ester (2.3 mg) which would be the same quantity as expected after trans-esterification of the internal standard.

In order to document trans-esterification of internal standard, three samples were trans-esterified as follows: 3% $H_2SO_4$ in ethanol at 80° C. for 24 hours. Recovery was as much as about 80 percent. FIG. 4 shows GC/FID of: (A) tobacco seed oil spiked with the glyceryl $C_{11}$ internal standard (2.15 mg) after trans-esterification of the mixture; (B) reaction product of tobacco seed oil trans-esterified then spiked with $C_{11}$ fatty acid ethyl ester (2.3 mg) which would be the same quantity as expected after trans-esterification of the internal standard. The $C_{11}$ fatty acid ethyl ester peak area for both chromatograms showed a similar area count. This experiment showed that the internal standard triglyceride conversion to $C_{11}$ fatty acid ethyl ester under these conditions was complete and no analyte was being lost during product work-up.

Three grams of tobacco seed oil were trans-esterified employing the above conditions employing $H_2SO_4$ catalyst. Reactions were carried out in triplicate. A similar process was applied to 3 grams of the internal standard. For each reaction, 40 mL of 3% $H_2SO_4$ in ethanol was added. Each mixture was refluxed at 80° C. for 24 hours. After reaction was complete, most of the ethanol was removed via vacuum distillation followed by addition of 5-10 mL of saturated NaCl solution. Each sample was then extracted with 3×20 mL of hexane. The combined hexane solutions from each sample were next dried by passing them though sodium sulfate followed by evaporation of the hexane using vacuum distillation. The actual total weights of FAEE from both tobacco seed oil and the internal standard were obtained via gravimetry. GC/FID was also used to obtain the exact weight of each FAEE. Table 3 shows (a) the starting weight of oil or tri-undecanoin internal standard used, (b) the expected weight of FAEE obtained, (c) the combined weights of FAEE's via gravimetry and individual weights of FAEE via GC/FID.

Figure 5:
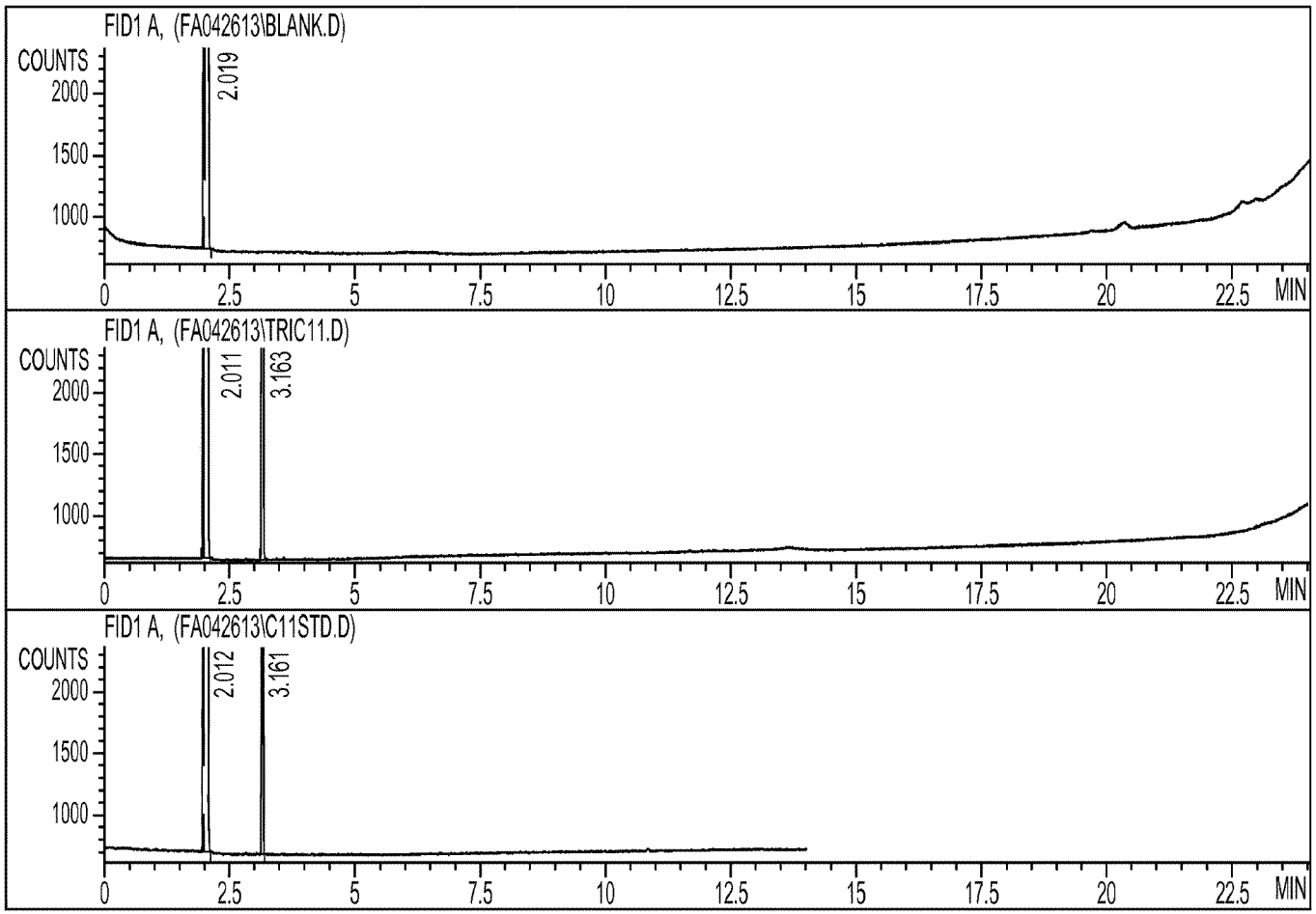
FIG. 5 shows in its upper panel a GC/FID chromatogram of blank $CH_2Cl_2$ solvent, in its central panel a GC/FID chromatogram 2.15 mg of trans-esterification reaction product of glyceryl $C_{11}$ and ethanol, dissolved in 10 mL $CH_2Cl_2$, and in its lower panel a GC/FID chromatogram of 2.3 mg $C_{11}$ fatty acid ethyl ester standard dissolved in 10 mL $CH_2Cl_2$.

Gravimetric analysis accordingly showed a recovery of 95-106% of fatty acid ethyl esters. At the same time, GC/FID analysis of the same fatty acid ethyl esters showed only a recovery of 76-82%. A high temperature GC/FID analysis by an independent laboratory (Medallion Labs, Minneapolis, Minn.) showed mostly the presence of fatty acid ethyl esters and less than 2-3% of triglyceride. As shown in FIG. 5, the GC/FID analysis of trans-esterified internal standard showed only the presence of $C_{11}$ fatty acid ethyl esters.

TABLE 3

Percent conversion to fatty acid ethyl esters

| Sample | Estimate TG Weight (g) Before TE | FAEE weight (g) After TE | Expected Weight of FAEE (g) | Weight (mg) of product after TE used for GC Analysis | Weights (mg) of FAEE obtained by GC/FID analysis using 1 point calibration for $C_{11}$ and 5 points for Oil | % Conversion via Total Mass Measurement | % Conversion GC-FID |
|---|---|---|---|---|---|---|---|
| Istd | 3.1867 | 3.2732 | 3.26 | 10 | 8.18 | 100.5 | 81.8 |
| Oil-1 | 3.0049 | 3.2535 | 3.07 | 19.3 | 15.15 | 106.0 | 78.5 |
| Oil-2 | 3.2931 | 3.468 | 3.36 | 18.1 | 13.75 | 103.1 | 76.0 |
| Oil-3 | 3.15 | 3.20 | 3.06 | 20 | 15.24 | 104.4 | 76.2 |

All products via trans-esterified oil were dissolved in 10 mL of dichloromethane for GC/FID analysis.

Figure 6:
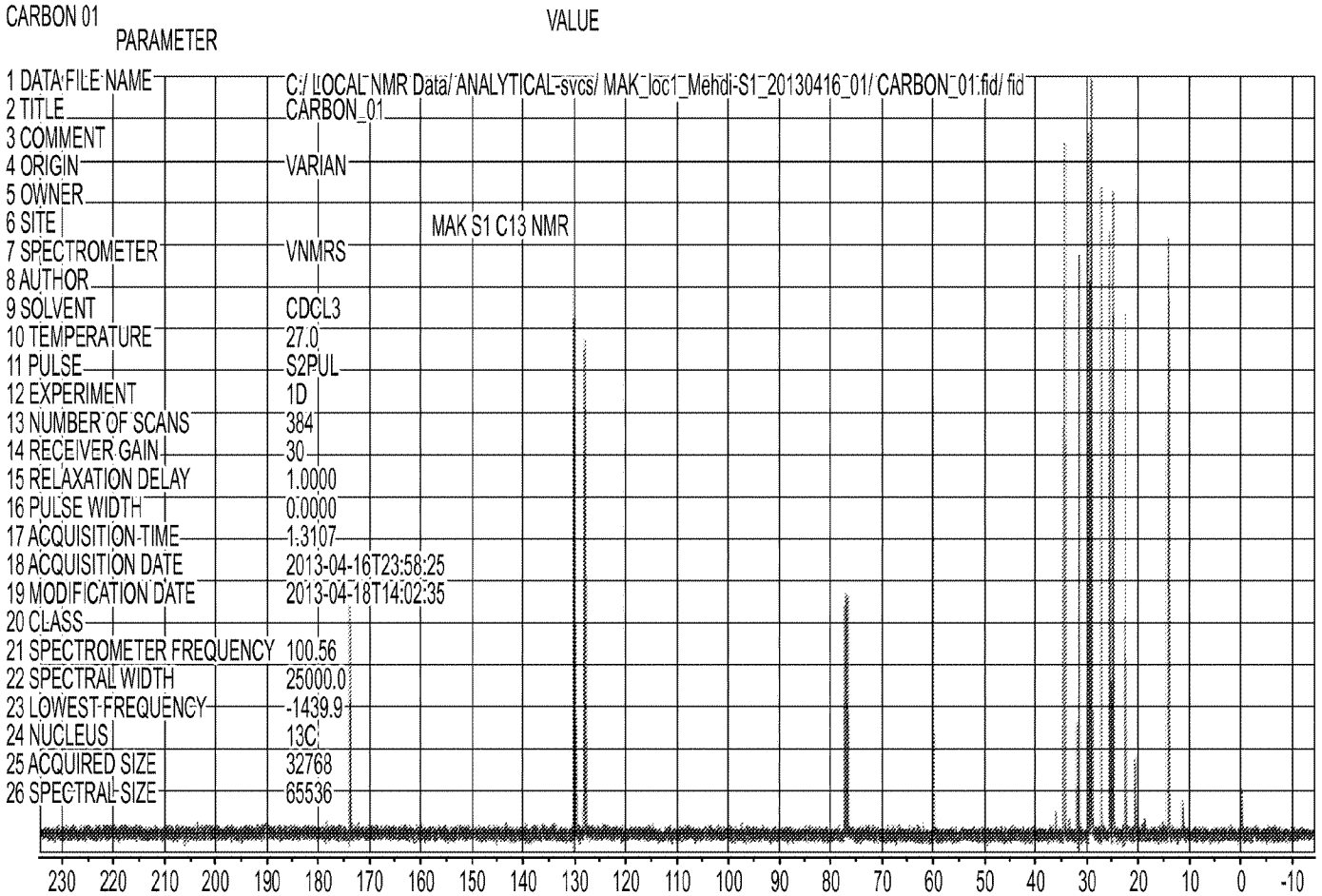
FIG. 6 shows a $^{13}C$ NMR spectrum of trans-esterification reaction product of tobacco seed oil and ethanol catalyzed by 3% $H_2SO_4$. Reaction had proceeded for 24 hours.
Figure 7:
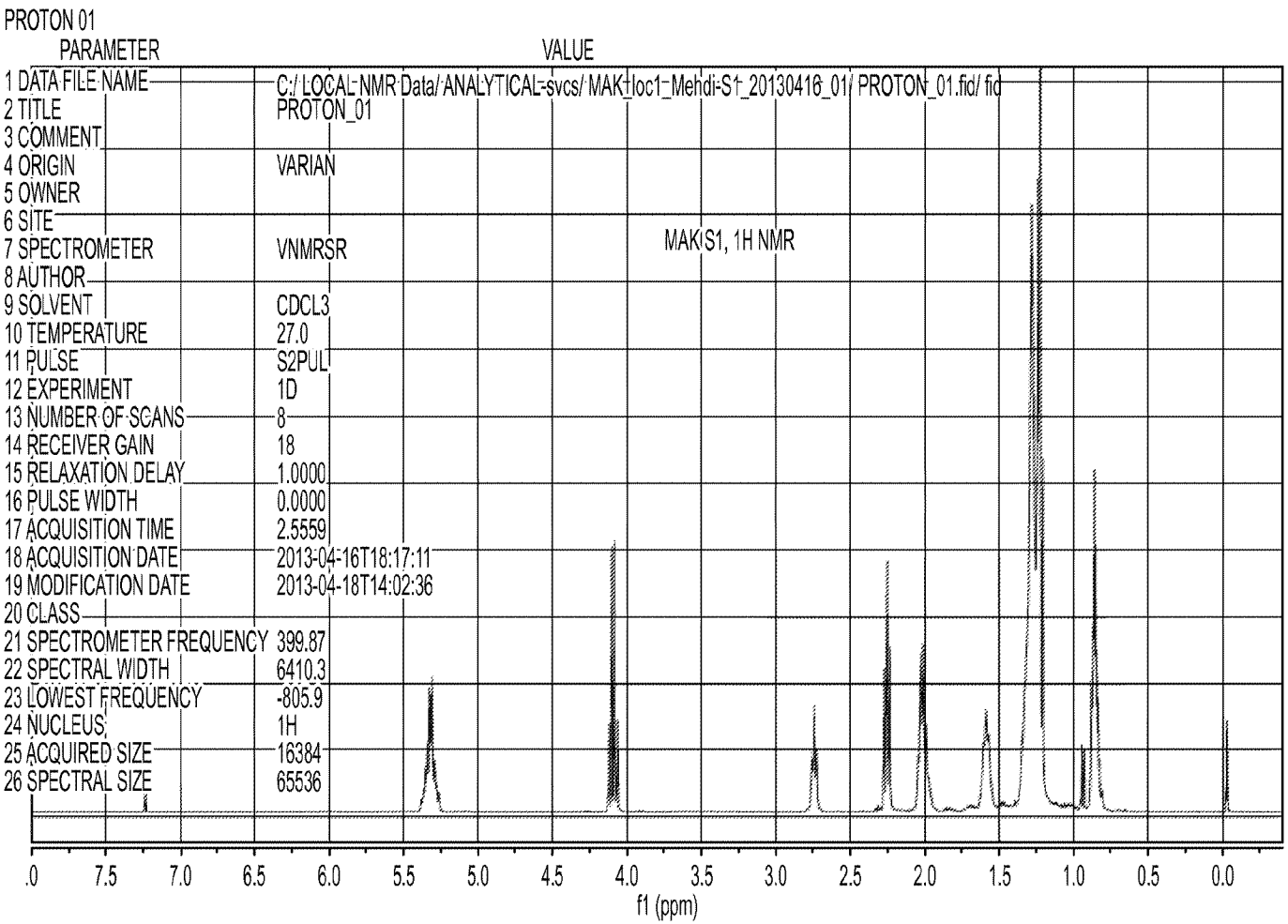
FIG. 7 shows a $^{1}H$ NMR spectrum of trans-esterification reaction product of tobacco seed oil and ethanol catalyzed by 3% $H_2SO_4$. Reaction had proceeded for 24 hours.
Figure 8:
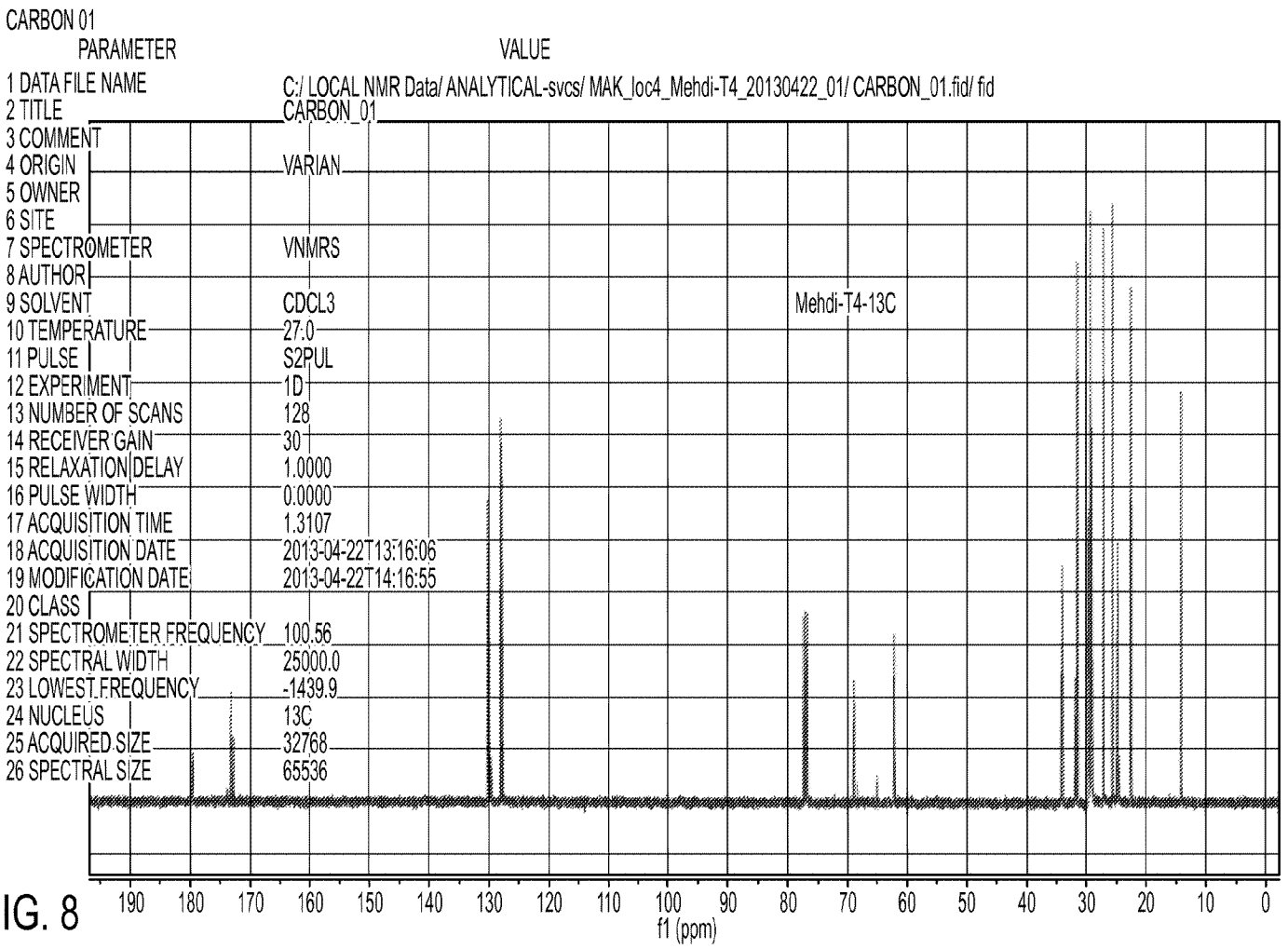
FIG. 8 shows a $^{13}C$ NMR spectrum of tobacco seed oil.

As shown in FIG. 6, $^{13}C$ NMR of the fatty acid ethyl esters revealed: 1) one carbonyl signal at ~170 ppm, consistent with the presence of one structure, 2) three signals around 130 ppm consistent with the alkene carbons of the long chain fatty acids, 3) one signal at ~60 ppm consistent with one type of C—O linkage, that is the α-carbon of the ethyl group, 4) a group of signals between 35 and 15 ppm consistent with alkyl carbons of the long chain fatty acid groups As shown in FIG. 7, proton NMR of the fatty acid ethyl esters revealed: 1) a signal at 5.5 ppm consistent with a proton attached to an unsaturated carbon, 2) a signal at 1.25 ppm consistent with protons attached to aliphatic carbons, and 3) signals around 4.5 ppm, consistent with protons attached to the glycerin backbone As shown in FIG. 8, $^{13}C$ NMR of tobacco seed oil revealed: 1) three carbonyl signals at ~180-170 ppm consistent with the presence of three carbonyl groups, although only two signals would have been predicted, 2) three signals at ~130 ppm consistent with the alkene carbons present in the alkyl side chains, 3) multiple signals of varying intensity between 70-60 ppm consistent with carbons attached to oxygen, although only two signals would have been predicted, and 4) multiple signals between 35-15 ppm consistent with alkyl carbons of the long chain fatty acid groups. An interpretation of these signals could be assigned to the presence of relatively small amounts of mono and diglycerides in the tobacco seed oil.

Figure 9:
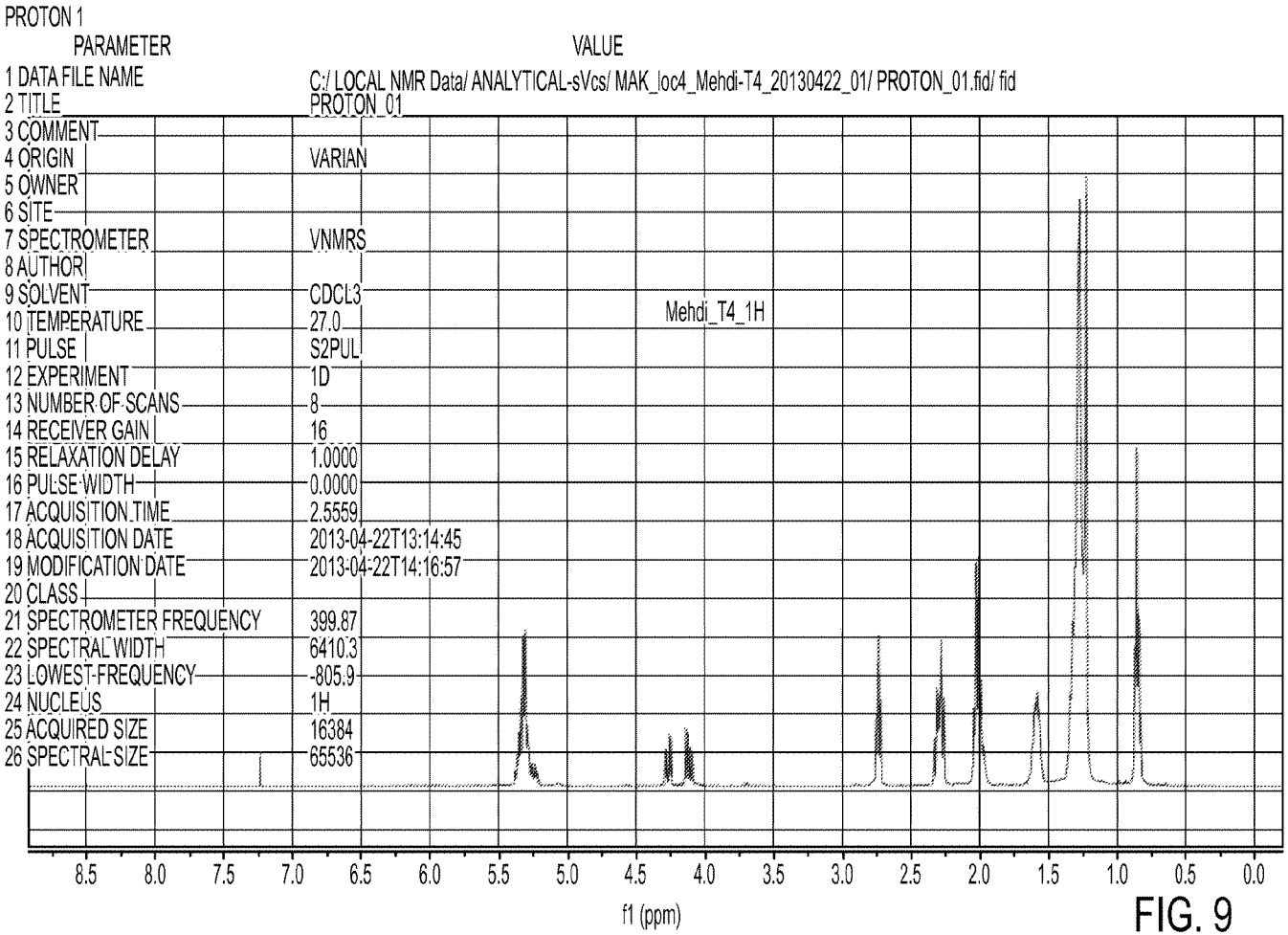
FIG. 9 shows a $^{1}H$ NMR spectrum of tobacco seed oil.

As shown in FIG. 9, proton NMR of the tobacco seed oil revealed: 1) a signal at 5.5 ppm consistent with a proton attached to an unsaturated carbon, 2) signal at 1.25 ppm consistent with protons attached to aliphatic carbons, and 3) signals around 4.5 ppm consistent with protons attached to the glycerin backbone.

Accordingly, the signals present in the trans-esterified reaction product are consistent with those of an ethyl ester of long chain unsaturated fatty acids. No other signals were present that would have suggested the presence of another structure.

Many modifications and other embodiments of a process such as is described in various embodiments herein will come to mind to one skilled in the art to which this disclosed process pertains having the benefit of the teachings presented in the foregoing description. Therefore, it is to be understood that a process such as is described in various embodiments herein is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed:

1. A process for making an ester of a fatty acid derived from tobacco seed oil, wherein the ester possesses favorable organoleptic properties, the process comprising contacting a quantity of a composition comprising tobacco seed oil containing $C_{11}$ triglycerides with (a) a quantity of a composition comprising an alcohol and a quantity of a composition comprising an acid or (b) a quantity of a composition comprising an alcohol and an acid to form a reaction mixture for a period of time sufficient for the formation of a composition comprising a $C_{11}$ fatty acid ester.

2. A process according to claim 1, wherein the composition comprising tobacco seed oil is reacted with a quantity of a composition comprising an alcohol and a quantity of a composition comprising an acid.

3. A process according to claim 1, wherein the composition comprising tobacco seed oil is reacted with a quantity of a composition comprising an alcohol and an acid.

4. A process according to claim 1, wherein the alcohol is ethanol.

5. A process according to claim 2, wherein the alcohol is ethanol.

6. A process according to claim 3, wherein the alcohol is ethanol.

7. A process according to claim 1, wherein the acid is sulfuric acid.

8. A process according to claim 3, wherein the acid is sulfuric acid.

9. A process according to claim 1, wherein the period of time is from one to 24 hours.

10. A process according to claim 1, wherein the composition comprising a $C_{11}$ fatty acid ester comprises less than 3% by weight $C_{11}$ triglycerides.

11. A process for making an ester of a fatty acid derived from tobacco seed oil, wherein the ester possesses favorable organoleptic properties, the process comprising contacting a quantity of a composition comprising tobacco seed oil containing $C_{11}$ triglycerides with (a) a quantity of a composition comprising ethanol and a quantity of a composition comprising an acid or (b) a quantity of a composition comprising ethanol and an acid to form a reaction mixture for a period of time sufficient for the formation of a composition comprising a $C_{11}$ fatty acid ethyl ester.

* * * * *